US006662738B2

(12) United States Patent
Estabrooks

(10) Patent No.: US 6,662,738 B2
(45) Date of Patent: Dec. 16, 2003

(54) LIFTING-SAIL BOAT APPARATUS AND METHOD

(76) Inventor: David Allen Estabrooks, 50 Water St., P.O. Box 519, Newburyport, MA (US) 01950

( * ) Notice: Subject to any disclaimer, the term of this patent is extended or adjusted under 35 U.S.C. 154(b) by 0 days.

(21) Appl. No.: 10/186,857

(22) Filed: Jul. 1, 2002

(65) Prior Publication Data

US 2003/0000441 A1 Jan. 2, 2003

Related U.S. Application Data

(60) Provisional application No. 60/302,326, filed on Jun. 29, 2001.

(51) Int. Cl.[7] ..... B63H 9/04

(52) U.S. Cl. ..... 114/102.1; 114/39.13

(58) Field of Search ..... 114/102.1, 102.16, 114/39.13, 39.15, 39.21, 39.28, 39.29, 39.31, 39.32

(56) References Cited

U.S. PATENT DOCUMENTS

| | | | | | |
|---|---|---|---|---|---|
| 2,724,356 | A | * | 11/1955 | Szakacs | 114/39.32 |
| 3,693,571 | A | * | 9/1972 | Hiscock | 114/39.29 |
| 4,922,846 | A | * | 5/1990 | Biagioli | 114/90 |
| 5,231,943 | A | * | 8/1993 | Benze | 114/39.13 |
| 5,423,274 | A | * | 6/1995 | Benze | 114/39.13 |

* cited by examiner

*Primary Examiner*—S. Joseph Morano
*Assistant Examiner*—Lars A. Olson

(57) ABSTRACT

A lifting-sail rig and method comprising airfoils, or efficient aerodynamically shaped leading edge soft sails, supported by an improved non-interfering fixed mast rig positioned away from the lifting-sail for increased aerodynamic efficiency and ease of sail or airfoil control. Stable sailboat performance is achieved at a higher speed for multihulls and widened beam monohulls for supporting the lifting-sail rig. The improved lifting-sail rig balances the large wind driven forces that have resulted in the capsizing of conventional monohull sailboats, and the pitch poling of multihulls.

14 Claims, 19 Drawing Sheets

LIFTING-SAIL BOAT APPARATUS AND METHOD

CROSS REFERENCE PRIORITY DATA

Provisional Patent Application No. 60/302,326 filed on Jun. 29, 2001.

BACKGROUND OF THE INVENTION

1. Field of the Invention

The present invention relates to sailboats and particularly to an improved lifting-sail rig and method for multihulls and wide beam monohulls with a simple, effective, seaworthy apparatus for the control of heeling with the capability for completely canceling the overturning moment.

2. Description of the Prior Art

The conventional stayed, fixed mast rig used with a weighted keel, monohull sailboat has proven successful in providing the most stable mode of sailing in heavy winds and seas, with shortened sail or reefing to avoid capsizing. The weighted ballast on a keel has proven successful in providing operating stability, but the added weight, keel surface area, and the heeled hull shape increases water drag. Smaller conventionally rigged, centerboard sailboats utilize crew weight to windward with sail easing and sail reefing, to balance the overturning moment created by high wind forces. Control of all conventional sailboats is limited by the need for ultimately "luffing", easing the sail outboard, or reefing for reducing the effective sail area to maintain stability against capsizing. Heeling results in loss of efficiency as a result of the added downward sail force or "weight", which greatly increases hydrodynamic drag, and a large loss in forward aerodynamic driving force. At small angles of heel a multihull having a wide beam and narrow hulls with reduced inertial drag, has proven more stable than a wide beam monohull. However, like any non-ballasted, lightweight sailboat, a multihull tends to capsize when it reaches negative stability in a heavy wind, usually at heel angles greater than about 50 degrees. The maximum design value of the its achieved righting moment limits a sailboat's "power to carry sail", whereas increased speed is directly related to the ability to carry a larger sail area where conventional sail rigs are deficient.

The relatively small "windsurfer" is the only commercially successful seaworthy lifting-sail craft that completely balances the overturning moment with crew weight. The windsurfer is a one person, aerodynamically efficient, simple, high-speed sailboard. U.S. Pat. No. 3,487,800 to Schweitzer and Drake discloses this lightweight windsurfer with a simple, base pivoting carbon fiber mast, integral with an aerodynamically shaped leading sail edge. The windsurfer sail is manually controlled by the operator, who maneuvers the sailboard by tilting the sail with an attached wishbone boom, fore and aft for steering, and outboard to windward for lifting and balance. The windsurfer operator can skillfully exercise control without capsizing in strong winds and turbulent seas. The planing windsurfer is the only production sailboat that has achieved a world speed record of 45 knots, even though in a 50 knot wind. Depending on the strength of the wind, by tilting the sail rig to windward, the operator can obtain near "lift-off" conditions where hydrodynamic drag approaches zero. A skilled operator can actually lift the sailboard out of the water briefly and return safely to the water surface. However, the upside growth of windsurfing has been limited by the fact that relatively strong wind conditions are required to optimize windsurfer sailing speed. For high speed in light to moderate winds, a large sail area is required in excess of about 10 square meters. But, only those strong sailors over 6 feet tall can generally realize the strength with enough moment arm to handle these larger sail areas with ease and effectiveness in a strong wind. Limited by the height and strength of the average human operator, the most utilized sail area is actually reduced to about 5 or 6 square meters. Consequently, the windsurfer with its operator supported tilting mast and lifting-sail has a ratio of maximum sail area to total weight ratio much lower than can be achieved with conventional monohulls and multihulls having conventional mounted fixed stayed, or carbon fiber masts.

One of the most rapidly growing high performance sailboat categories is multihulls. Catamarans or trimarans can carry a large sail area, but are more difficult to control than the simpler windsurfer. Multihulls have a tendency in a strong wind to heel to an angle of negative stability, pitch pole, or capsize. However, stayed fixed mast sailboats have proven to have a suitable platform for practical innovations that enhance performance and stability. Conventional vertical sailing rigs may have simple fore and aft stays and side stays or shrouds that substantially support the fixed mast in pitch, roll, and yaw. Alternating pitching forces with the high stress concentrations do not cause premature failure of conventional rigging, and is adequately strong and seaworthy to withstanding the high cyclical stresses from the sail pitching moment in rough seas.

An experimental sailboat named Yellow Pages Endeavor, with an efficient 300 square foot airfoil supported by three stays attached to three short planing hulls asymmetrically arranged, attained the worlds speed record in October 1993 of over 46.5 knots or 53.6 mph in only an 18 knot breeze in relatively smooth water. Furthermore, the iceboat with a stayed mast-sail rig is a good example of the highest speed potential of over 80 knots with extremely low drag on ice.

Prior art lifting-sail arrangements including those that physically mount and rotate the sail about a fixed mast, have proven to be overly complex and difficult to operate. Furthermore, they are difficult to tack or change direction, and they do not have the capability to fully counteract heeling for a complete righting moment. A swing sail rig disclosed in U.S. Pat. No. 4,799,443 to Vogel, comprises a sail luff boom mounted on a single multi-hinge fitting at a pivot point above the sail center of effort with the upper region of the luff boom attached to the top of a short fixed mast. The single multi-hinge fitting connects the luff boom to the mast for both supporting and articulating the swing sail rig. The small multi-hinge mast fitting attached at the mast head allows the sail to rotate vertically around the mast, while rotating about the axis of the luff boom for altering the angle of attack of the sail to the relative wind direction. At the same time the sail can swing or tilt outboard to some extent under the driving force of the wind. Difficulty in maneuvering the luff boom, fixed only to the single mast support fitting results in mechanical interference with the mast. Also, the fixed mast placed in front of the luff boom in close proximity to the swing sail, results in aerodynamic sail interference with increased drag. When sailing to windward, the most critical and difficult point of sailing, the single multi-hinge fitting would tend to have difficulty enduring the very large torsional stresses from the sail forward driving force, and the large pitching moment between the sail center of effort and the multi-hinge fitting, particularly as the sail tends to twist or pitch aft. The strength may be improved as disclosed in U.S. Pat. No. 6,189,472 to Duncan by providing support of the swing sail with an additional swing boom to the boat deck. However, the short swing boom length required to adequately strengthen the rig, limits the outboard swing and the subsequent achievable righting moment. An early U.S. Pat. No. 1,670,936 to McIntyre discloses an early lifting-sail and mast apparatus allowing the sail center of effort to swing outboard to the lee side of the mast, and to pass thru the keel center of lateral resistance for realizing a complete righting moment for all points of sailing. The lee outboard support for the complex rotating lifting-sail apparatus includes a sprit-boom mechanism coupled to the fixed mast, but not substantially supported against pitch, roll, and yaw.

Consequently, improved simpler, more substantial and reliable fixed mast lifting-sail rig and method is needed for controlling heeling with the capability for a complete righting moment under high wind operating conditions. The simple lifting-sail rig apparatus and method of the present invention, with effective operator control, is more aerodynamically efficient, being positioned forward of a conventional fixed mast rigging with a mast-sprit. A preferred embodiment utilizes a low drag carbon fiber, simplified mast rig with the improved high aspect ratio lifting-airfoil or lifting-sail, that operates automatically with rapid response in the same simple, natural way of a conventional sail. To achieve the foregoing and other objects in accordance with the purpose of the present invention, according to one aspect of these novel improvements, various related versions of the preferred lifting-sail rig and method are disclosed.

SUMMARY OF THE INVENTION

The improved airfoil or lifting-sail rig for driving or propelling a sailboat, may comprise preferably, a simple carbon fiber aft positioned mast with a lower vertical portion and a short, horizontal mast-sprit upper portion projecting forward from the top of the vertical mast portion for supporting the lifting-sail or lifting-airfoil. An aerodynamic shaped luff-spar is attached to the leading edge of the sail or integral with the airfoil leading edge design. A universal head coupling connects the head end of the luff-spar to the middle region of the mast-sprit portion for unrestricted upward tilting or lifting of the sail or airfoil at the mast-sprit to produce a complete righting moment. Support of the luff-spar against fore and aft pitching is controlled, particularly when sailing to windward by a substantial guy wire that may be a rigid rod or fore-spar. The guy wire is connected between a luff-spar coupling that may be located in the mid region of the luff-spar and a coupling at the forward end of the mast-sprit. This simple method of tilting the airfoil or sail to adjust the heel control is about the axis defined by the mast sprit. The angle of attack of the lifting-sail is altered by rotating the luff-spar about an axis defined by a line between the universal head coupling and the luff-spar coupling.

An alternative lifting-sail rig embodiment may comprise a stayed mast with spreaders that prevent buckling of the mast and distortion of the rig during the pitching, (torsional) yawing, and rolling motion of the sailboat. Again a short, horizontal mast-sprit portion projects forward from the top region of the aft mast for supporting an efficient lifting-sail.

The efficient lifting-sail apparatus is easily controlled by the operator with the aid of the wind naturally forcing the sail into the desired attitude of lift angle and angle of attack in the same manner as a conventional sail. The sail or airfoil may be operated by two sheets, one to control horizontal (outward lifting) tilt preferably at the tack, and the other to control the upper edge of the sail or airfoil may include a top boom with a main sheet leading from the top region of the mast for controlling the angle of attack by the operator. Alternatively, a main sheet leading from the clew may be used to control rotation of the sail angle of attack to the relative wind direction. The balancing lifting force of the sail may un-weight the sailboat and reduce the hydrodynamic drag to a near zero "lift-off" state, or a complete righting moment may be achieved by the unrestricted upward tilting of the sail or airfoil as desired by the operator.

The objective is to increase the improved lifting-sail rig apparatus high wind speed potential beyond conventional sailboats, with ease of handling, safety, durability, and control in heavy winds and seas. An improved aerodynamically efficient and reliable sailboat, can achieve higher speeds with stability and control over capsizing on all points sailing.,

OBJECTS AND ADVANTAGES

A primary objective of this present invention is to provide an improved lifting-sail rig high speed sailboat, that achieves stability and control over capsizing on all points sailing, with ease of handling in heavy winds and seas.

Another objective is to provide a simple, efficient lifting-sail rig capable of easily and naturally inclining upward to a high lift position, for optimum control of the heeling force with the capability for complete balance of the overturning moment.

Another objective is to provide a simple, efficient lifting-sail rig capable of an unrestricted upward lifting-sail orientation for the maximum lift position of the sail rig in very strong winds, with the lifting resultant passing directly through the keel center of lateral resistance for complete balance of the overturning moment.

Another objective is to achieve a low aerodynamic drag lifting-sail stayed mast and rigging with good sea keeping ability and superior structural strength.

Another objective is to achieve a low aerodynamic drag lifting-sail simple carbon fiber mast and rigging with good sea keeping ability and superior structural strength.

Another objective is to achieve a low aerodynamic drag lifting-sail stayed mast and rigging with good sea keeping ability and superior structural strength.

Another objective of this present invention is to control the lifting-sail rig with the wind naturally forcing the sail into the desired attitude of lift angle and angle of attack.

Still another objective of this invention is to achieve a larger sail coefficient of lift, higher aspect ratio, more efficient sails or airfoils to achieve a higher overall driving force.

Another objective is to utilize the improved stability of the lifting-sail result afforded by the "windsurfer" with the attendant, un-weighted, minimum area hull planing capability with reduced hull drag.

Another objective is to achieve an apparatus with maximum spacing between the sail center of effort and the keel center of lateral resistance to permit the angle of the lifting-sail to be as near vertical as feasible with the overturning moment completely balanced.

Another objective is to provide a method for complete balance of the overturning moment of a lifting-sail rig multihull with only one hull in the water for reduced drag, by causing the lifting-sail to heel the catamaran to windward, thereby moving the center of lateral resistance to the keel of the windward hull.

Another objective is to provide complete balance of the overturning moment of a lifting-sail rig trimaran, moving the center of lateral resistance to the fin of the windward ama, or outrigger of the trimaran, furthest to windward from the lifting rig center of effort.

Another objective is to provide a low profile drag airfoil or sail rig for a safe "hove to", or non driving condition, whereby the sail rig may be orientated by the wind force into near horizontal, or vertical "luffing" position facing into the wind.

Another objective is to provide a safe "hove to", or non-driving condition, whereby a lifting sail or rigid airfoil may be lowered into a rest or nesting position on the deck for mooring or docking the sailboat.

Another objective of this invention is to permit the use of a delta shaped sail or airfoil with an efficient tapered, aerodynamic shape to provide a higher coefficient of lift, lower center of effort, lifting-sail rig with ease of handling and good sea keeping ability, which may be light weight and inflatable similar to conventional delta shaped hang-gliders and kites.

Another objective is to provide dual airfoils, as a fixed bi-plane, or in tandem that may be rotated into the advantageous, efficient "safe leeward position" configuration, to lower the center of effort and increase the righting moment with minimum aerodynamic drag.

Another objective is to maximize the hull speed in relatively calm seas, with a plurality of small surface area, short planing pods having reduced hydrodynamic drag.

Another objective is a craft comprising a least three, but preferably four widely spaced of short planing pods that may be interconnected in a symmetrical array, with small hydrofoils for control and lift.

Another objective is to provide an adequate space between short planing hulls for a crew cockpit, cabin or living quarters without interference from the lifting-sail rig.

Another objective is to maximize the hull speed in ocean going windward performance, with small surface area, very long narrow semi-circular hulls having low wave drag and low inertial drag.

Another objective is to achieve ultimate safety and heavy weather multihull operation, sea-keeping ability, and a built in life saving provision, particularly for trimarans, catamarans, or similar multihull craft adapted with at least one self righting, detachable "life support" elevated capsule or large crew pod with a self-sufficient spaceship-like quality.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

REFERENCE NUMERALS

Lifting-Sail Method and Apparatus 2
Aft Mast Lifting-Sail Rig Apparatus 3
Bent Flexible Aft Mast Lifting-Sail Rig Apparatus 4
"A" Frame Aft Mast Lifting-Sail Rig Apparatus 5
Jib/Mainsail Aft Mast Lifting-Sail Rig Apparatus 6
Rotating Bi-Plane Lifting-Sail Rig Apparatus 7
Joined Dual Tandem Airfoil Lifting-Sail Rig Apparatus 8
Delta Airfoil Aft Mast Lifting-Sail Rig Apparatus 9
Reinforced Aft Mast Midpoint Spreader Lifting-Sail Rig Apparatus 10
Forward Mast Lifting-Sail Rig Apparatus 11
Lifting-Sail Docking Apparatus 12
Bent Flexible Aft Mast Lifting-Rotor Rig Apparatus 13
Extended Beam Planing Hull 14
Main Deck 14*d*
Trimaran Main Hull 14*t*
Starboard Hull 14*s*
Port Hull 14*p*
Rudder 16
Starboard Rudder 16*s*
Port Rudder 16*p*
Keel or Hydrofoil 18
Keel or Hydrofoil Center of Lateral Resistance 18*clr*
Starboard Keel or Hydrofoil 18*s*
Port Keel or Hydrofoil. 18*p*
Lifting-Sail 20
Lifting-Jib 20*j*, Lifting-Mainsail 20*m*
Sail Center of Effort 20*ce*
Jib Sheet 21*j*, Main Sheet 21*m*
Symmetrical Lifting-Airfoil 22
Symmetrical Lifting-Airfoil Rear Flap 22*r*
Symmetrical Lifting-Airfoil Forward Wing 22*f*
Symmetrical Lifting-Airfoil Middle Wing 22*m*
Lifting-Airfoil Center of Effort 22*ce*
Symmetrical Delta-Shaped Lifting-Airfoil 23
Symmetrical Joined Tandem Lifting-Airfoil 24
Symmetrical Lifting-Airfoil Articulating Linkage 26
Lifting-Sail Symmetrical Airfoil Luff-Spar 28
Lower Sail Boom 30
Lower Wishbone Sail Boom 30*w*
Sail Batten 31
Upper Sail Boom 32
Upper Wishbone Sail Boom 32*w*
Mast-Sprit/Luff-Spar Head Universal Coupling 34
Mast-Sprit/Luff-Spar Head Universal Halyard 34*h*
Symmetrical Airfoil Fore-Spar 36
Guy wire 36*g*
Mast-Sprit/Luff-Spar Halyard 36*h*
Upper Sail/Airfoil Angle of Attack Control Sheet 38
Fore-Spar/Luff-Spar Coupling 40
Mast-Sprit Coupling 42
Mast-Sprit 44
Flexible Bent Mast-Sprit 46
"A" Frame Mast 48
"A" Frame Starboard Leg 48*s*
"A" Frame Port Leg 48*p*
Symmetrical Airfoil Vertical Mast 50
Mast-Sprit Stay 52
Luff-Spar Head 54
Luff-Spar Tack 56
Lower Boom/Sail or Airfoil Angle of Attack Control Sheet 58
Luff-Spar/Sail or Airfoil Tilt Sheet 60
Starboard Forestay 62*s*
Port Forestay 62*p*
Starboard Backstay 64*s*
Port Backstay 64*p*
Vertical Mast Maximum Buckling Stress Point 66
Starboard Mast Spreader 66*s*
Port Mast Spreader 66*p*
Bi-Plane Rotary Yardarm 68
Bi-Plane Rotary Yardarm Bearing 69
Planing Multihull 70
Elevated Crew Capsule 71
Planing Pods 72
Starboard mast-sprit spreader 74*s*
Port mast-sprit spreader 74*p*
Starboard mast-sprit stay 75*s*
Port mast-sprit stay 75*p*
Starboard mast-sprit jumper stay 76*s*
Port mast-sprit jumper stay 76*p*
Starboard mast jumper stay 78*s*
Port mast jumper stay 78*p*

Lifting-Rotor Center Bearing 79

Lifting-Rotor 80

Lifting-Rotor End Plates 81

Lifting-Rotor Lower Bearing 82

Lifting-Rotor Drive Motor 83

Lifting-Rotor Axis of Rotation 84

DETAILED DESCRIPTION OF PREFERRED EMBODIMENTS

Figure 1:
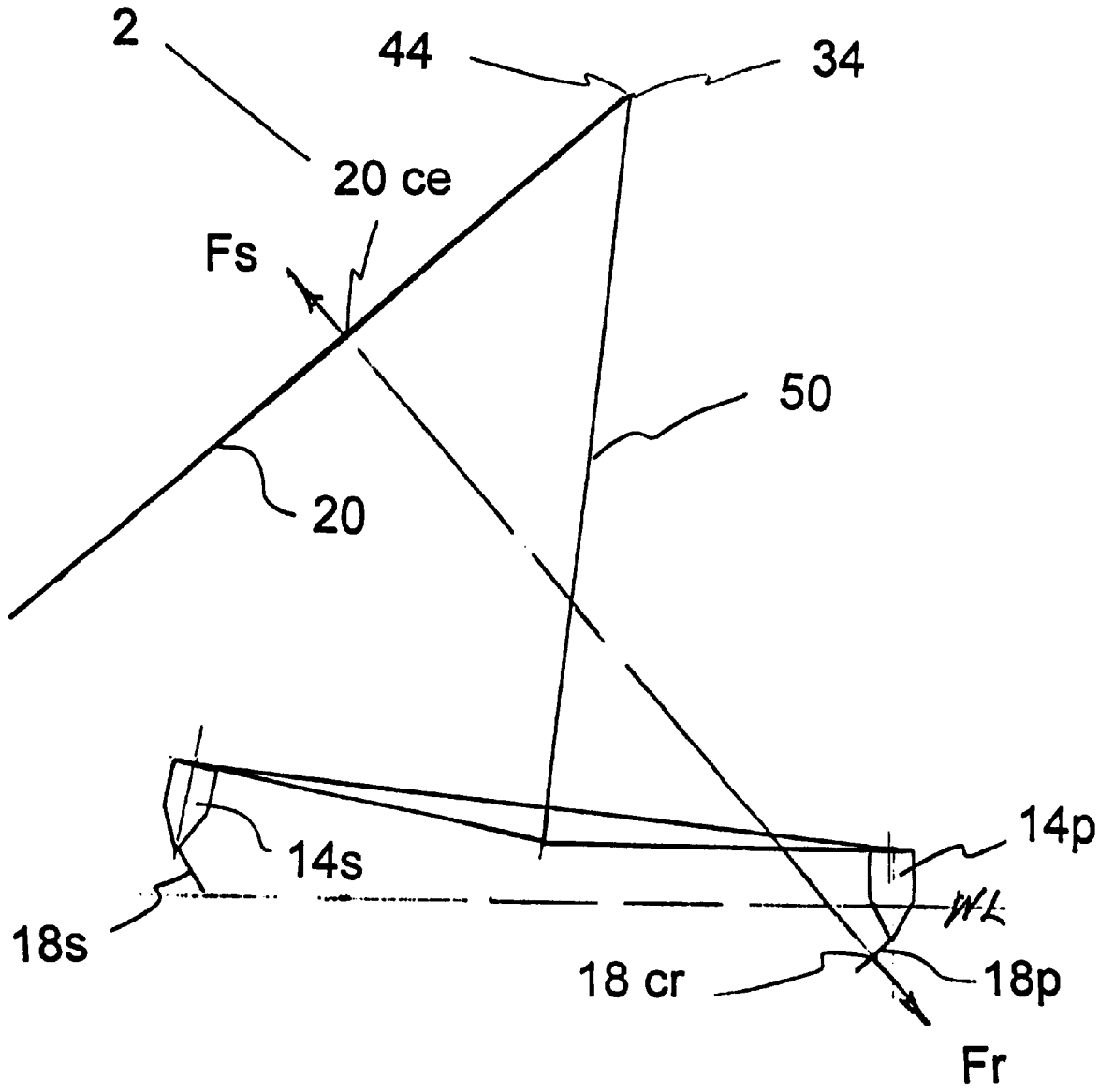
FIG. 1 is an explanatory diagram of first preferred embodiment showing an optimum positioning method of windward tilting the lifting-sail rig to cancel the overturning moment, the rig comprising a vertical mast and an attached horizontal mast-sprit, with a low aerodynamic drag sail hinged from the mast sprit, inward canted hydrofoils, and four simple supporting stays suitable for a wide beam monohull or a multihull. The unique mast-sprit rig with minimum spars and stays of low drag is positioned aft of the lifting-sail to result in no aerodynamic sail interference.
Figure 1A:
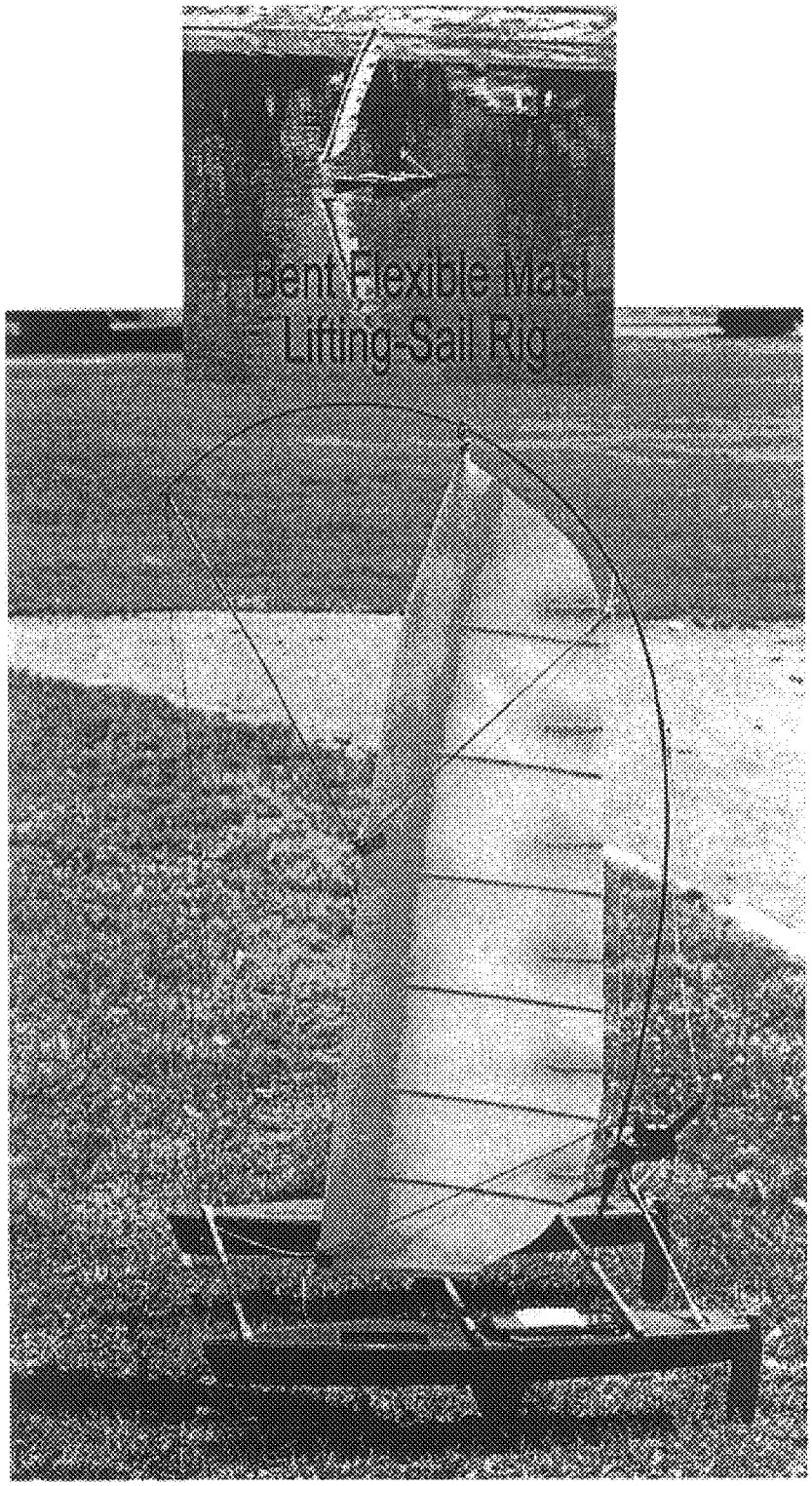
(FIG. 1*a* shows photographs of this simple operating lifting-sail rig apparatus reduced to practice according to the present invention.)
Figure 11:
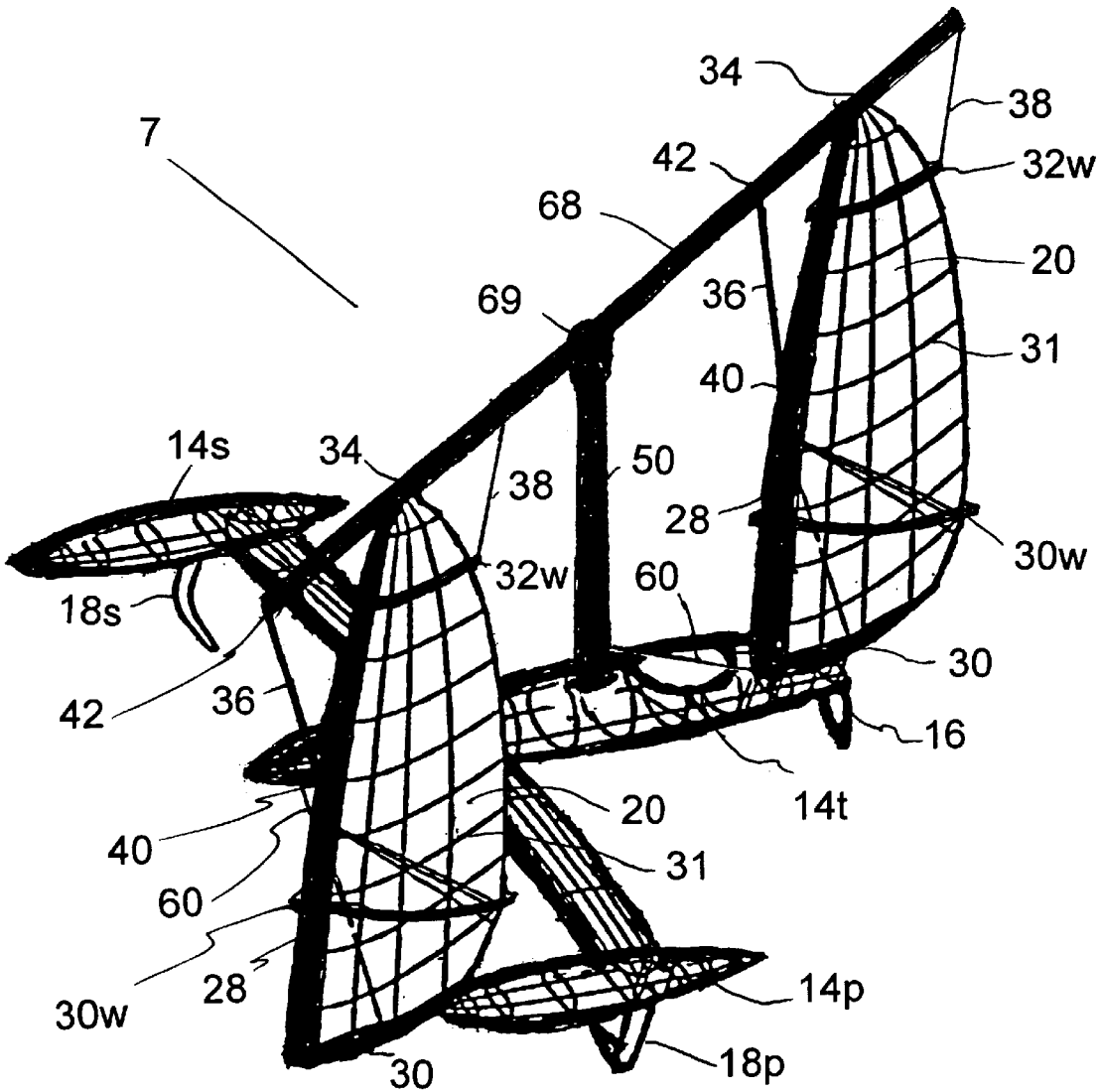
FIG. 11 is an explanatory diagram of a preferred embodiment employing the "biplane" effect with two widely spaced lifting sails or lifting airfoils resulting in a lowered center of effort lifting-sail rig apparatus and method. The biplane mounted on a fixed mast with a horizontal yardarm may be rotated to the more effective "safe leeward position" configuration. The lowered center of effort, provides a more effective righting moment. Also, with a large free area on the main hull self righting, detachable "life support" elevated capsule or large crew pod with a spaceship-like quality may be utilized as a crew cockpit, cabin or living quarters without interference from the rotating lifting-sail rig.

FIG. 1 is an explanatory diagram showing the lifting-sail principle of the first preferred lifting-sail rig embodiment. As shown with this lifting-sail principle, the optimum heeling position with minimum drag is too windward with the lee hull 14*s* out of the water. The leeward tilt angle of the lifting-sail 20 cancels the overturning moment with the side force Fs at the lifting-sail 20 center of effort 20*ce* passing through the keel or centerboard 18*p* center of lateral resistance 18*cr* with force Fr equal to lifting-sail 20 side force Fs. The lifting-sail rig method and apparatus 2 comprises a vertical mast 50 with a horizontal mast-sprit 44, supporting a low aerodynamic drag lifting-sail 20 hinged from the mast sprit 44 with a universal coupling 34. The vertical mast 50 with a mast-sprit 44 is positioned aft of the lifting-sail 20 without aerodynamic interference. Inward canted hydrofoil 18*s* on starboard hull 14*s*, and inward canted hydrofoil 18*p* on port hull 14*p* provides the counteracting Force Fr of lateral resistance. With the overturning moment completely balanced by the lifting-sail rig method and apparatus 2, the angle of the lifting-sail 20 should be as near vertical as possible to maintain the highest forward driving force. This is accomplished with the beam distance maximized between the lifting-sail 20 center of effort 20*ce* and the keel or centerboard 18*p* center of lateral resistance 18*cr*. The preferred method is to heel the catamaran to windward with the lifting-sail 20, thereby lifting the lee hull 14*s* out of the water, and moving the center of lateral resistance 18*cr* to the keel 18*p* of the windward hull 14*p*. Starboard 16*s* and port 16*p* rudders provide directional control. With a trimaran, as shown in FIG. 11, the center of lateral resistance 18*r* is on the inward canted fin 18*p* of the windward ama, or outrigger 15*p* of the trimaran, which is furthest to windward from the lifting-sail 20 center of effort 20*ce*.

The vertical component of the driving force Fs of lifting-sail 20, un-weights the starboard hull 14*s*, reducing the hydrodynamic drag to zero in the "lift-off" state. The simple, efficient lifting-sail 20 is capable of easily and naturally inclining upward to a high lift position, with safety, stability, and optimum control of the lifting force Fs for complete balance of the overturning moment. The lifting-sail 20 has the stability of the "windsurfer" method along with the attendant, un-weighted, minimum area hull planing capability, ease in rapid tacking, and reduced hull drag as a result of the upward aerodynamic force.

Figure 2:
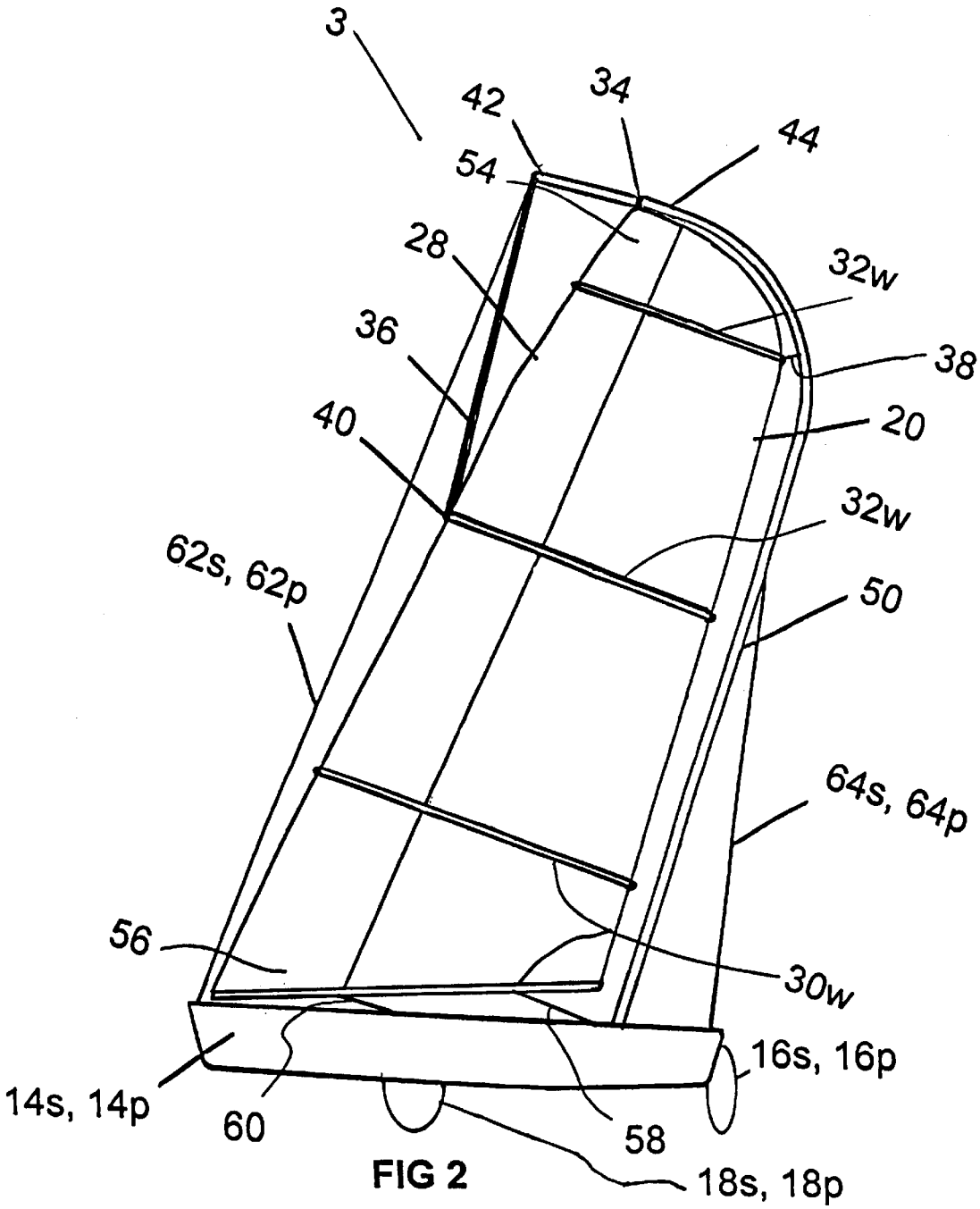
FIGS. 2 and 3 are the explanatory diagrams of a first preferred embodiment of the lifting-sail rig apparatus, comprising a low aerodynamic drag sail, a carbon fiber vertical mast and horizontal mast-sprit, inward canted keels or hydrofoils, and four simple supporting stays mounted on a multihull such as a catamaran. The minimum mast structure is positioned aft of the lifting-sail to prevent aerodynamic interference.
Figure 3:
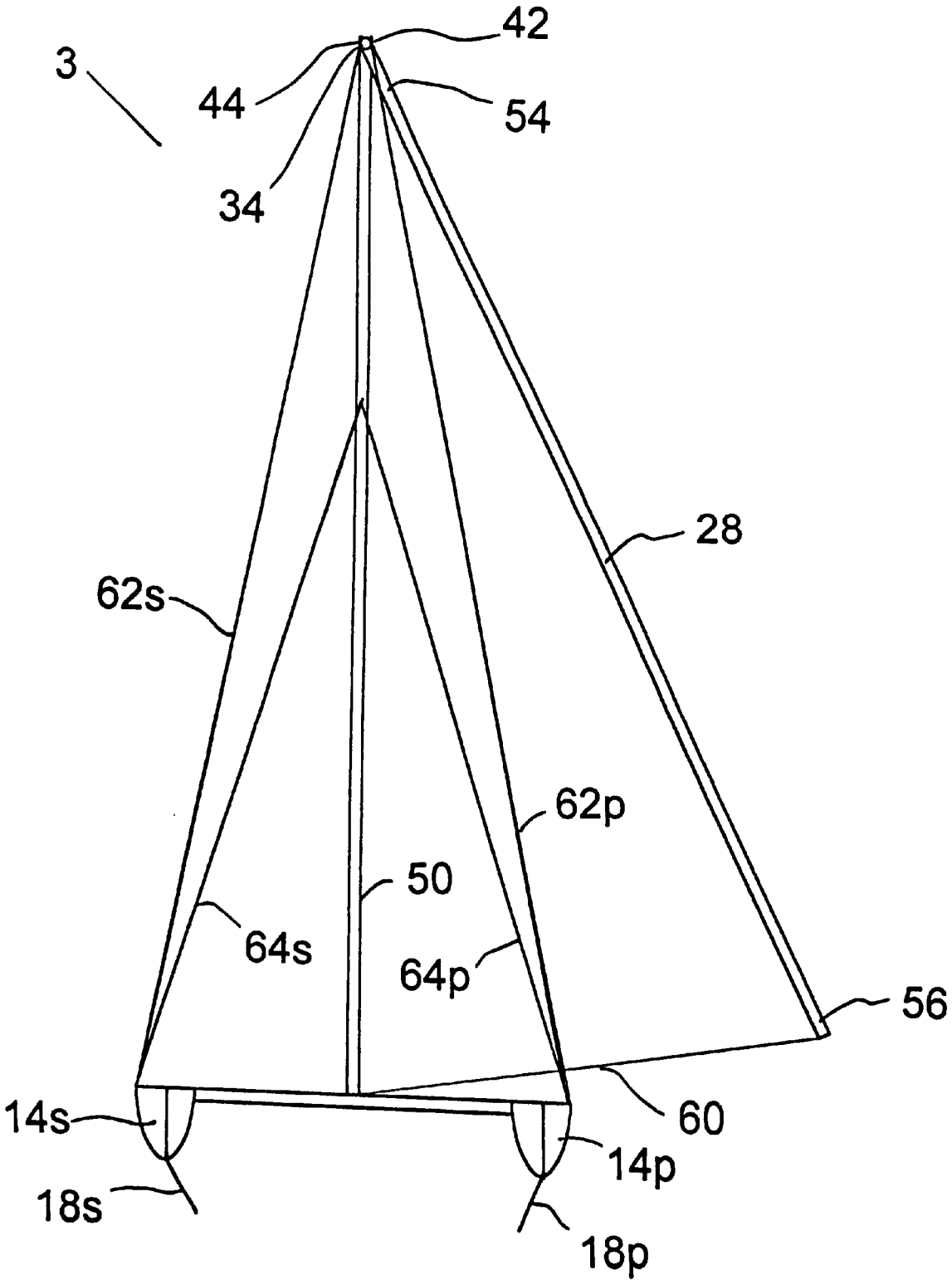

FIGS. 2 and 3 are the explanatory diagrams of a first preferred embodiment of a simple, carbon fiber or formed aft mast lifting-sail rig apparatus 3. The improved lifting-sail 20 comprises a fixed vertical mast 50 with a short mast-sprit 44 projecting forward at the top of the vertical mast 50 for supporting the lifting-sail 20. The vertical mast 50 is positioned aft of the lifting-sail 20 without aerodynamic interference. The mast sprit 44 is laterally supported by two widely spaced forestays, starboard 62*s* and port 62*p*. The vertical mast 50 is supported by two widely spaced backstays, starboard 64*s* and port 63*p*. Inward canted hydrofoil 18*s* on starboard hull 14*s*, and inward canted hydrofoil 18*p* on port hull 14*p* provide the lateral resistance. Starboard 16*s* and port 16*p* rudders provide directional control. An aerodynamically shaped, symmetrical airfoil luff-spar 28 is attached to or integral with the leading edge of the lifting-sail 20 extending from the luff spar tack 56 to the luff spar head 54 of the lifting-sail 20. The mast-sprit 44 luff-spar 28 universal coupling 34 connects the head end 54 of the luff-spar 28 to the middle region of the mast-sprit 44 thereby hinging the lifting-sail 20 for unrestricted upward tilting to produce a complete righting moment. Support of the luff-spar 28 against aft pitching of the lifting-sail 20 is controlled, particularly when sailing to windward by a guy wire 36*g*, or alternatively, a symmetrical airfoil fore-spar 36, particularly for fore pitching of the lifting-sail 20 when sailing downwind.

The fore-spar 36, or alternatively guy wire 36*g*, is connected between a luff-spar coupling 40 located in the mid region of the luff-spar 28 and a coupling 42 at the forward end of the mast-sprit 44. Simple rotation of the lifting-sail 20 for adjusting its angle of attack to the relative wind is about an axis along the luff-spar 28 defined by a line between the luff-spar coupling 40 attached on the leading edge of the luff-spar 28 and the mast-sprit-spar universal coupling 34 located at the mid-region of the mast-sprit 44. Upper wishbone booms 32*w* and lower wishbone booms 30*w* are attached to the luff-spar 28 for rotating the lifting-sail 20 to reverse and vary the camber of the lifting-sail 20. A lower angle of attack control sheet 58 may be attached to the lower boom 30*w* and lead to the deck 14*d* for additional control. Tilt sheet 60 for lifting-sail 20 is also attached to the lower boom 30*w* and leads aft to the deck 14*d* for ease of lifting-sail 20 tilt adjustment, while tensioning the guy wire 36*g*, particularly for sailing down wind.

Figure 4:
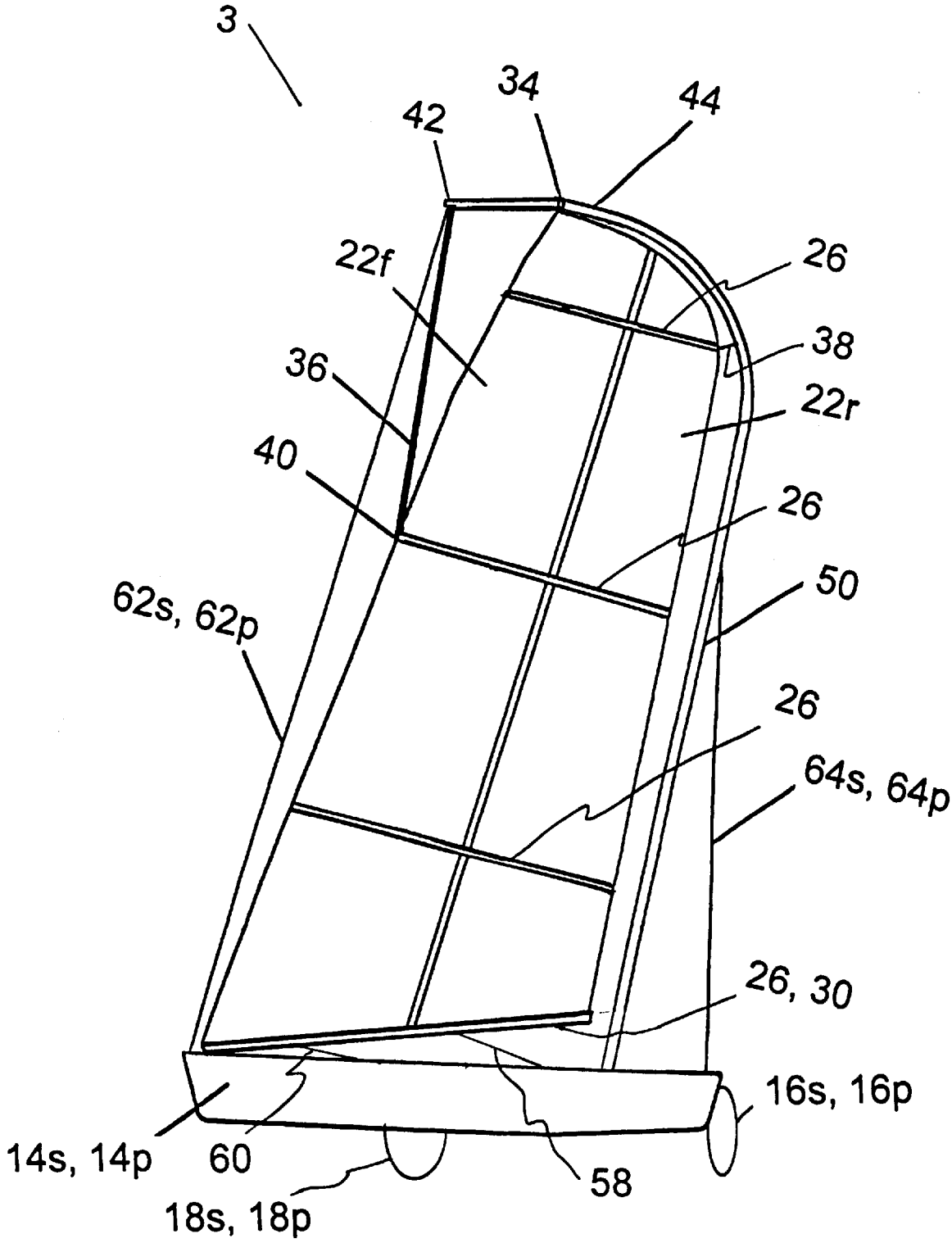
FIG. 4 is an explanatory diagrams of the first preferred embodiment of the lifting-sail rig, comprising a low aerodynamic drag symmetrical wing with a rear flap, a carbon fiber vertical mast with a horizontal mast-sprit, inward canted hydrofoils, and four simple supporting stays. The minimum mast structure is positioned aft of the lifting-sail to prevent aerodynamic interference.

FIG. 4 is an explanatory diagram of the first preferred embodiment of the aft mast lifting-sail rig apparatus 3 shown in FIGS. 2 and 3, but with a higher coefficient of lift, lower aerodynamic drag, symmetrical lifting-airfoil 22 comprising a symmetrical forward wing 22*f* with a rear flap 22*r*. Symmetrical lifting-airfoil articulating linkages 26 are attached to the symmetrical forward wing 22*f*, and the rear flap 22*r* to reverse and vary the camber of symmetrical lifting-airfoil 22. The angle of attack of the lifting-symmetrical airfoil 22, is controlled primarily by an upper control sheet 38 leading from the trailing end of the top symmetrical airfoil articulating linkage 26 to the mast-sprit 44 and leading down to the deck 14*d* for rotating the symmetrical lifting-airfoil 22 with ease of adjustment.

Inward canted hydrofoil 18*s* on starboard hull 14*s*, and inward canted hydrofoil 18*p* on port hull 14*p* provide the lateral resistance. Starboard 16*s* and port 16*p* rudders provide directional control. A lower angle of attack control sheet 58 may be attached to the lower boom 30*w* or and leads to the deck 14*d* for additional control. Tilt sheet 60 for lifting-sail 20 is also attached to the lower boom 30*w* and leads aft to the deck 14*d* for lifting-sail 20 tilt adjustment, while tensioning the guy wire 36*g*, particularly for sailing down wind. Support of the luff-spar 28 against aft pitching of the lifting-sail 20 may be controlled by a symmetrical airfoil fore-spar 36, particularly for fore aft pitching of the lifting-sail 20.

Figure 5:
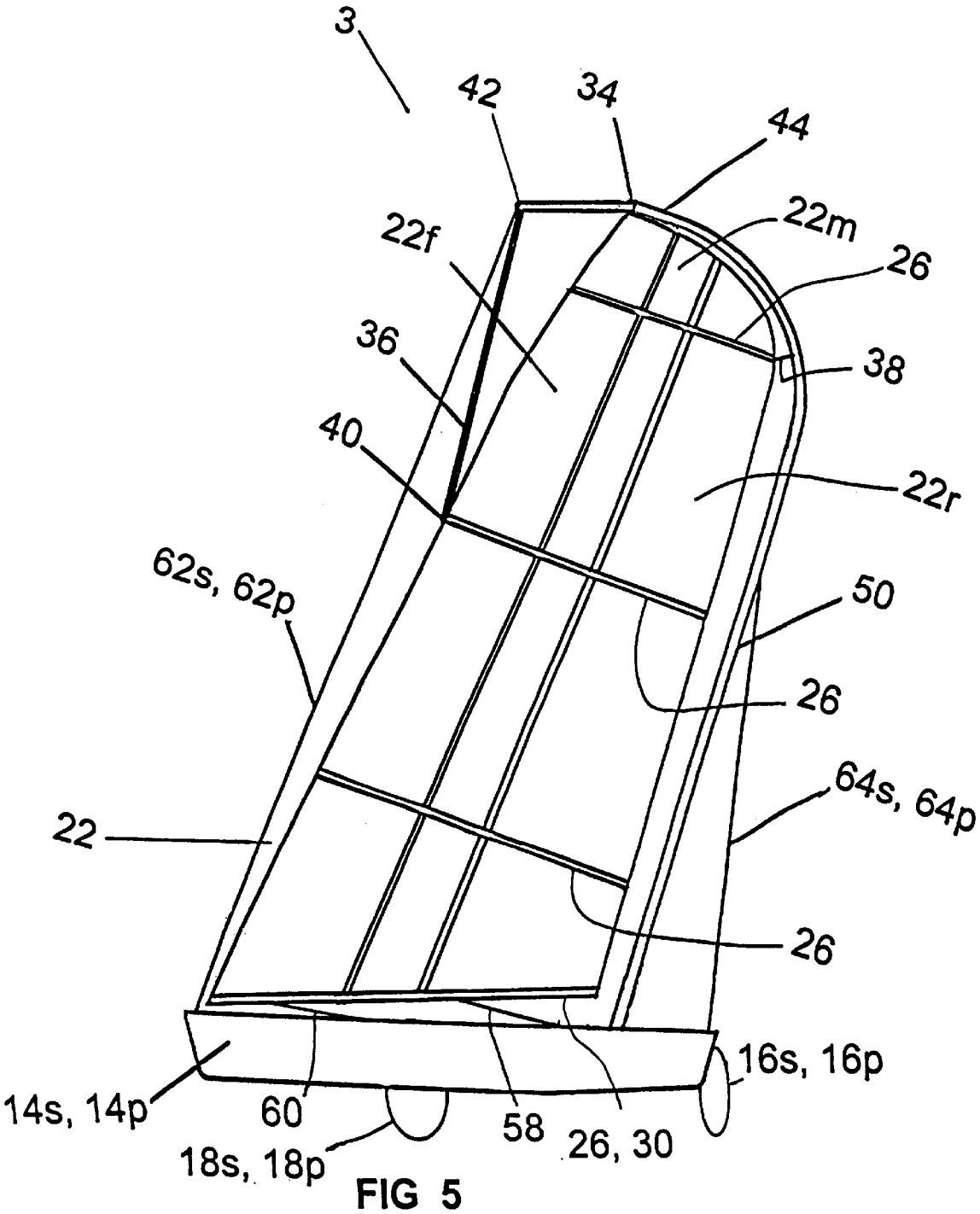
FIG. 5 is an explanatory diagram of the first preferred embodiment of the lifting-sail rig apparatus, comprising a low aerodynamic drag, high coefficient of lift, symmetrical slotted airfoil with camber reversing, a formed or carbon fiber vertical mast with a horizontal mast-sprit, canted hydrofoils, and four simple supporting stays. The minimum mast structure is positioned aft of the lifting-sail to prevent aerodynamic interference.

FIG. 5 is an explanatory diagram of the first preferred embodiment of the aft mast lifting-sail rig apparatus 3 shown in FIGS. 2 and 3, and FIG. 4, but with a slotted high coefficient of lift, symmetrical lifting-airfoil 22 with a low aerodynamic drag, symmetrical forward wing 22*f*, a middle wing 22*m*, and a rear flap 22*r*. Symmetrical lifting-airfoil articulating linkages 26 are attached to the symmetrical forward wing 22*f*, the middle wing 22*m*, and the rear flap 22*r* to reverse and vary the camber of symmetrical lifting-airfoil 22. The angle of attack of the lifting-symmetrical airfoil 22, is controlled primarily by an upper control sheet 38 leading from the trailing end of the top symmetrical airfoil articulating linkage 26 to the mast-sprit 44 and leading down to the deck 14*d* for rotating the symmetrical lifting-airfoil 22 with ease of adjustment. Inward canted hydrofoil 18*s* on starboard hull 14*s*, and inward canted hydrofoil 18*p* on port hull 14*p* provide the lateral resistance. Directional control is provided by starboard 16*s* and port 16*p* rudders. A lower angle of attack control sheet 58 may be attached to the lower boom 30*w* and lead to the deck 14*d* for additional control. Tilt sheet 60 for lifting-sail 20 is also attached to the lower boom 30*w* and leads aft to the deck 14*d* for ease of slotted airfoil 22 tilt adjustment, while tensioning the guy wire 36*g*, particularly for sailing down wind. Support of the luff-spar 28 against aft pitching of the lifting-sail 20 is controlled, particularly when sailing to windward by the guy wire 36*g*, or alternatively, a symmetrical airfoil fore-spar 36 may be used, particularly for fore pitching of the lifting-sail 20 when sailing downwind.

Figure 6:
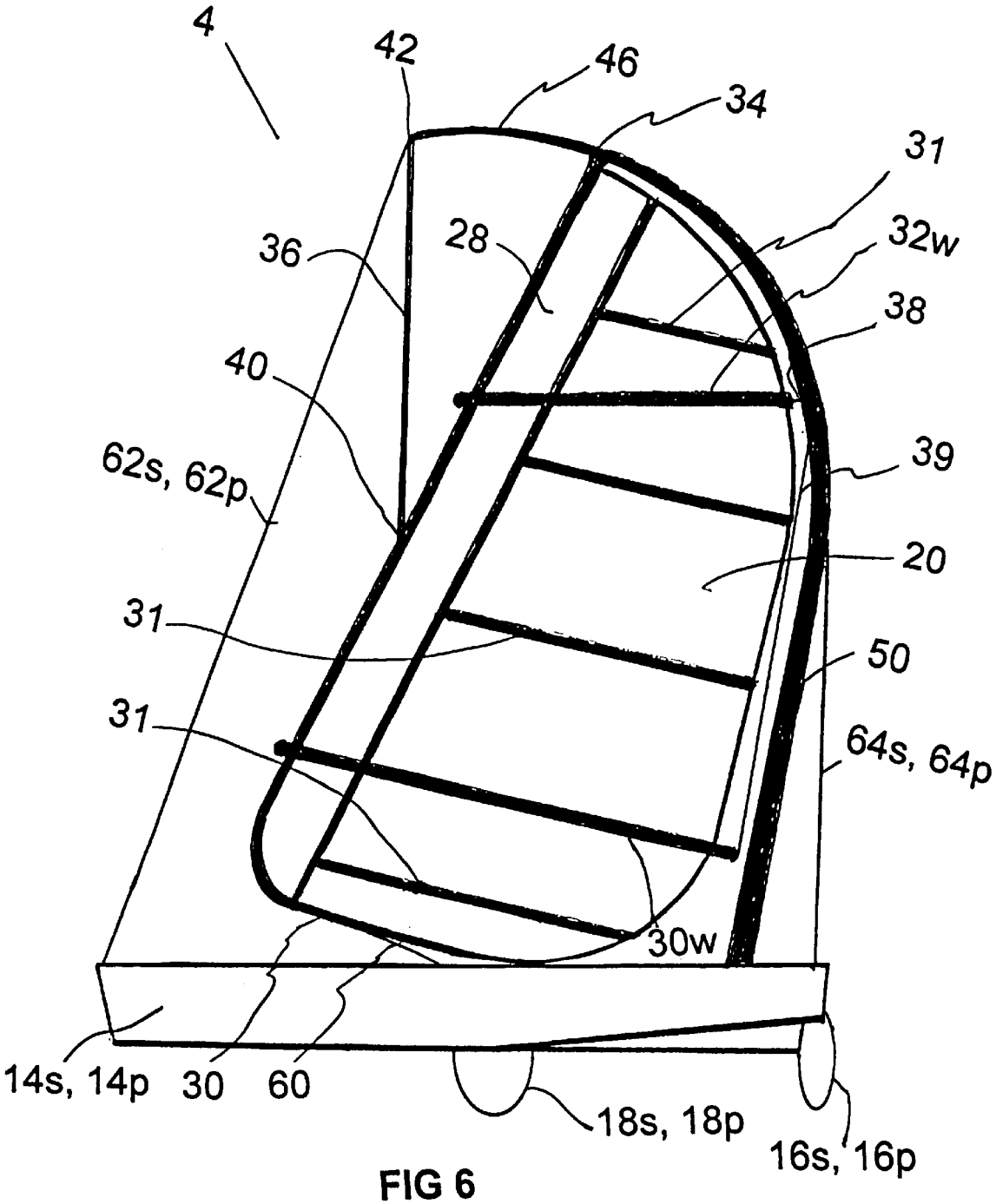
FIG. 6 is an explanatory diagrams of a preferred embodiment of the lifting-sail rig apparatus, comprising a low aerodynamic drag sail, a carbon fiber, vertical mast including a flexible bent mast-sprit, inward canted hydrofoils, and four simple supporting stays. The minimum mast structure is positioned aft of the lifting-sail to prevent aerodynamic interference.

FIG. 6 is an explanatory diagrams of a first preferred embodiment of a bent flexible mast lifting-sail rig apparatus 4, comprising a fixed carbon fiber vertical mast 50 with a short bent flexible mast-sprit 46 projecting forward at the top of the vertical mast 50 for supporting the lifting-sail 20. The vertical mast 50 is positioned aft of the lifting-sail 20 without aerodynamic interference. The mast sprit 46 is laterally supported by two widely spaced starboard 62*s* and port 62*p* forestays. The vertical mast 50 may be supported by two widely spaced starboard 64*s* and port 63*p* backstays. An aerodynamically shaped, symmetrical airfoil luff-spar 28 is attached to or integral with the leading edge of the lifting-sail 20 extending from the luff spar tack 56 to the luff spar head 54 with battens 31 spaced vertically to maintain the shape of the lifting-sail 20 The bent mast-sprit 46 to luff-spar 28 universal coupling 34 connects the luff spar head 54 of the luff-spar 28 to the middle region of the bent mast-sprit 46 for hinging the lifting-sail 20 with the universal coupling 34 for unrestricted outward tilting of the lifting-sail 20 to produce a complete righting moment. Support of the luff-spar 28 against fore and aft pitching of the lifting-sail 20 is preferably controlled by a symmetrical airfoil fore-spar 36. Alternatively a guy wire 36*g* may be utilized under tension when sailing downwind. The symmetrical airfoil fore-spar 36 is connected between a luff-spar coupling 40 located in the mid region of the luff-spar 28 and a coupling 42 at the forward end of the bent mast-sprit 46. Inward canted hydrofoil 18*s* on starboard hull 14*s*, and inward canted hydrofoil 18*p* on port hull 14*p* provide the lateral resistance. Directional control is provided by starboard 16*s* and port 16*p* rudders. Simple rotation of the lifting-sail 20 for adjusting its angle of attack to the relative wind is about an axis defined by a line between the luff-spar coupling 40 attached on the leading edge of the luff-spar 28 and the mast-sprit-spar universal coupling 34 located at the mid-region of the mast-sprit 46. Upper wishbone boom 32*w* is attached to the luff-spar 28 to reverse and vary the camber of the lifting-sail 20. The angle of attack of the symmetrical lifting-airfoil 22, is controlled primarily by an upper control sheet 38 leading from the trailing end of the upper wishbone boom 32*w* to the bent mast-sprit 46 and leading down to the deck 14*d* for rotating the symmetrical lifting-airfoil 22 with ease of adjustment. Lower wishbone boom 30*w* is attached to the luff-spar 28 to reverse and vary the camber in the lower region of the lifting-sail 20. The angle of attack of the symmetrical lifting-airfoil 22, is controlled primarily by an lower control sheet 58 leading from the trailing end of the upper wishbone boom 32*w* to the bent mast-sprit 46 and leading down to the deck 14*d* for rotating the lower region of the symmetrical lifting-airfoil 22. Lifting-sail 20 tilt sheet 60 is also attached to the lower short sail boom 30 and leads aft to the deck 14*d* for ease of tilt adjustment.

Figure 7:
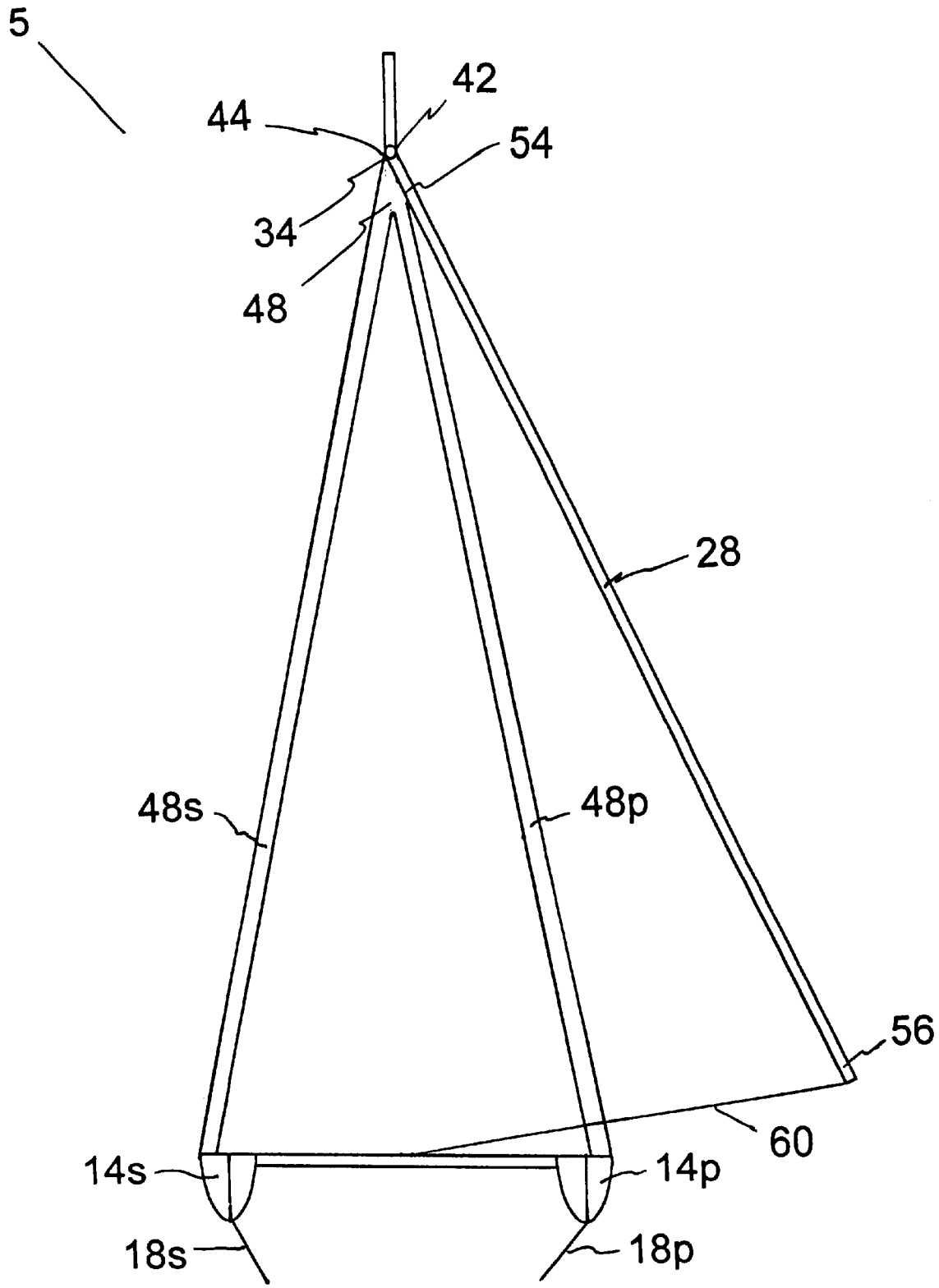
FIGS. 7 and 8 are the explanatory diagrams of a first preferred embodiment of the lifting-sail rig, comprising a low aerodynamic drag sail, an "A" Frame mast with a horizontal mast-sprit, inward canted hydrofoils, and dual supporting forestays mounted on a sailboat such as a catamaran. The low aerodynamic drag lifting-sail or lifting-airfoil may be lowered between the "A" frame to a "docking" position on the deck of the wide beam sailboat or multihull. The minimum "A" Frame mast structure is positioned aft of the lifting-sail to prevent aerodynamic interference.
Figure 8:
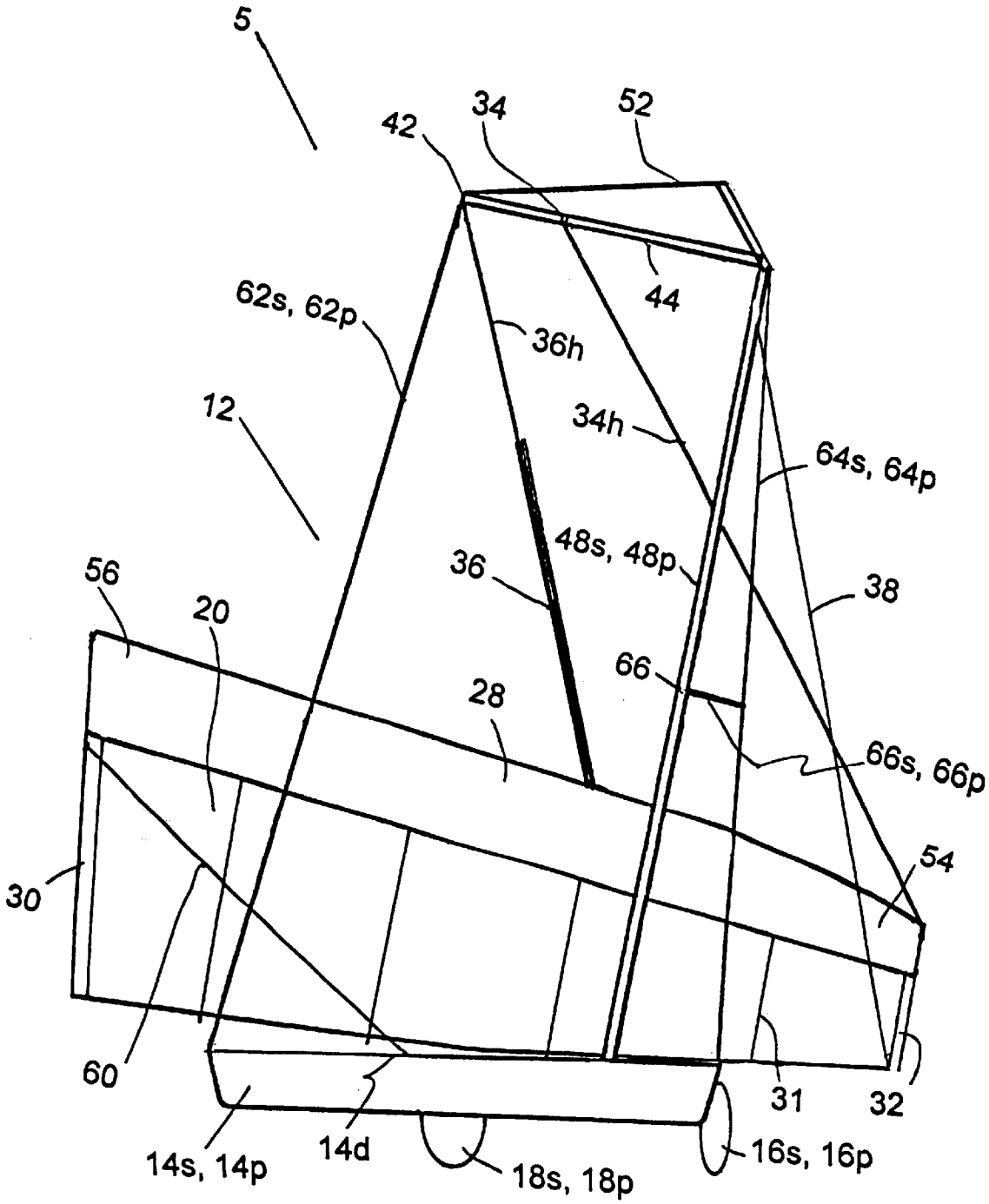

FIGS. 7 and 8 are the explanatory diagrams of a first preferred embodiment of an "A" Frame aft mast lifting-sail rig apparatus 6, comprising an "A" Frame mast 48 with a short mast-sprit 44 projecting forward supported by mast-sprit stay 52 at the top of the "A" Frame mast 48 for supporting the lifting-sail 20. The "A" Frame mast 48 is positioned aft of the lifting-sail 20 without aerodynamic interference. The mast sprit 44 is laterally supported by two widely spaced starboard 62*s* and port 62*p* forestays. Inward canted hydrofoil 18*s* on starboard hull 14*s*, and inward canted hydrofoil 18*p* on port hull 14*p* provide the lateral resistance: Directional control is provided by starboard 16*s* and port 16*p* rudders.

The "A" Frame mast 48 comprises two widely spaced "A" Frame legs, starboard 48*s* and port 48*p* supported at the maximum buckling stress point 66 by mast spreaders, starboard 66*s* and port 66*p* with starboard 64*s* and port 64*p* backstays. An aerodynamically shaped, symmetrical airfoil luff-spar 28 is attached to or integral with the leading edge of the lifting-sail 20 extending from the luff spar tack 56 to the luff spar head 54. The mast-sprit 44 to luff-spar 28 universal coupling 34 connects the luff-spar head 54 to the middle region of the mast-sprit 44 for hinging the lifting-sail 20 for unrestricted upward tilting to produce a complete righting moment. Support of the luff-spar 28 against fore and aft pitching of the lifting-sail 20 is preferably controlled by a symmetrical airfoil fore-spar 36. Alternatively a guy wire 36*g* may be utilized under tension when sailing downwind.

The symmetrical airfoil fore-spar 36 is connected between a luff-spar coupling 40 located in the mid region of the luff-spar 28 and a coupling 42 at the forward end of the mast-sprit 44. Simple rotation of the luff-spar 28 for adjusting the lifting-sail 20 angle of attack to the relative wind is about an axis defined by a line between the luff-spar coupling 40 attached on the leading edge of the luff-spar 28 and the mast-sprit-spar universal coupling 34 located at the mid-region of the mast-sprit 44. Upper boom 32 is attached to the luff-spar head 54 to reverse and vary the camber of the lifting-sail 20. An upper angle of attack control sheet 38 is attached to the aft end of upper boom 30 and leads along the mast-sprit 44 to the deck 14*d* (not shown) for ease of adjustment. Lower boom 30 may be attached to the luff-spar tack 56 to reverse and vary the camber of the lifting-sail 20. A lower angle of attack control sheet 58 may be attached to the lower boom 30 and lead to the main deck 14*d* for additional control. Tilt sheet 60 for lifting-sail 20 is also attached to the lower boom 30 and leads aft to the main deck 14*d* for ease of lifting-sail 20 tilt adjustment. Inward canted hydrofoil 18*s* on starboard hull 14*s*, and inward canted hydrofoil 18*p* on port hull 14*p* provide the lateral resistance. Directional control is provided by starboard 16*s* and port 16*p* rudders.

As shown in FIG. 8, the low aerodynamic drag lifting-sail 20, or alternatively a lifting-airfoil 22, may be lowered by a "docking" position apparatus 12 onto the main deck 14*d* with halyard 34*h* from coupling 34 and halyard 36*h* from mast-sprint tip coupling 42, or the symmetrical airfoil fore-spar 36, and may be controlled in docking position by tilt sheet 60.

Figure 9:
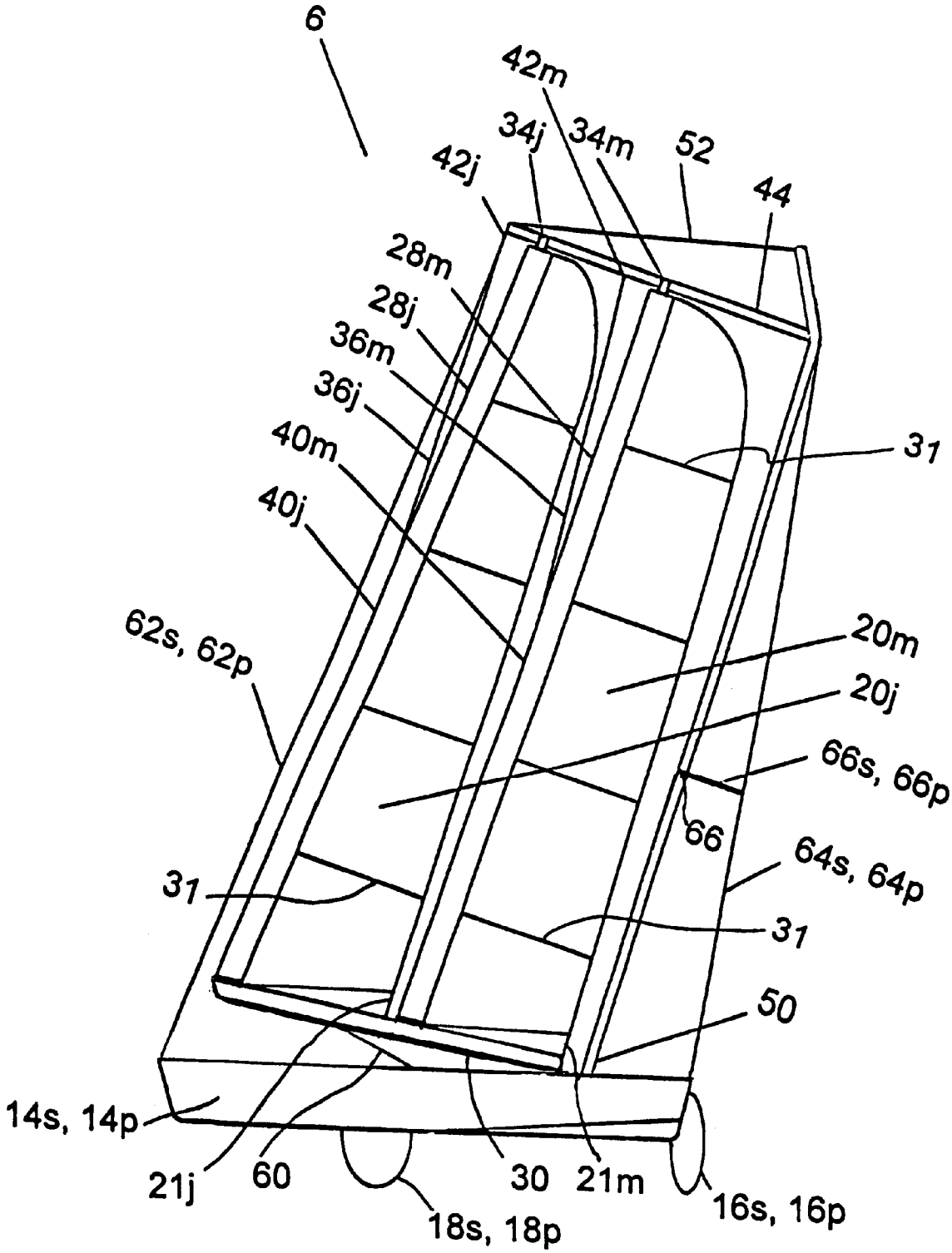
FIGS. 9 and 10 are the explanatory diagrams of a first preferred embodiment of the lifting-sail rig, comprising dual low aerodynamic drag sails with two adjacent lifting-sails that take advantage of the "slot effect" derived by the combined conventional jib and mainsail interaction, a vertical mast with a mast-sprit, canted hydrofoils, spreaders at the mast maximum buckling stress point, and four simple supporting stays. The minimum mast structure is positioned aft of the lifting-sail to prevent aerodynamic interference.
Figure 10:
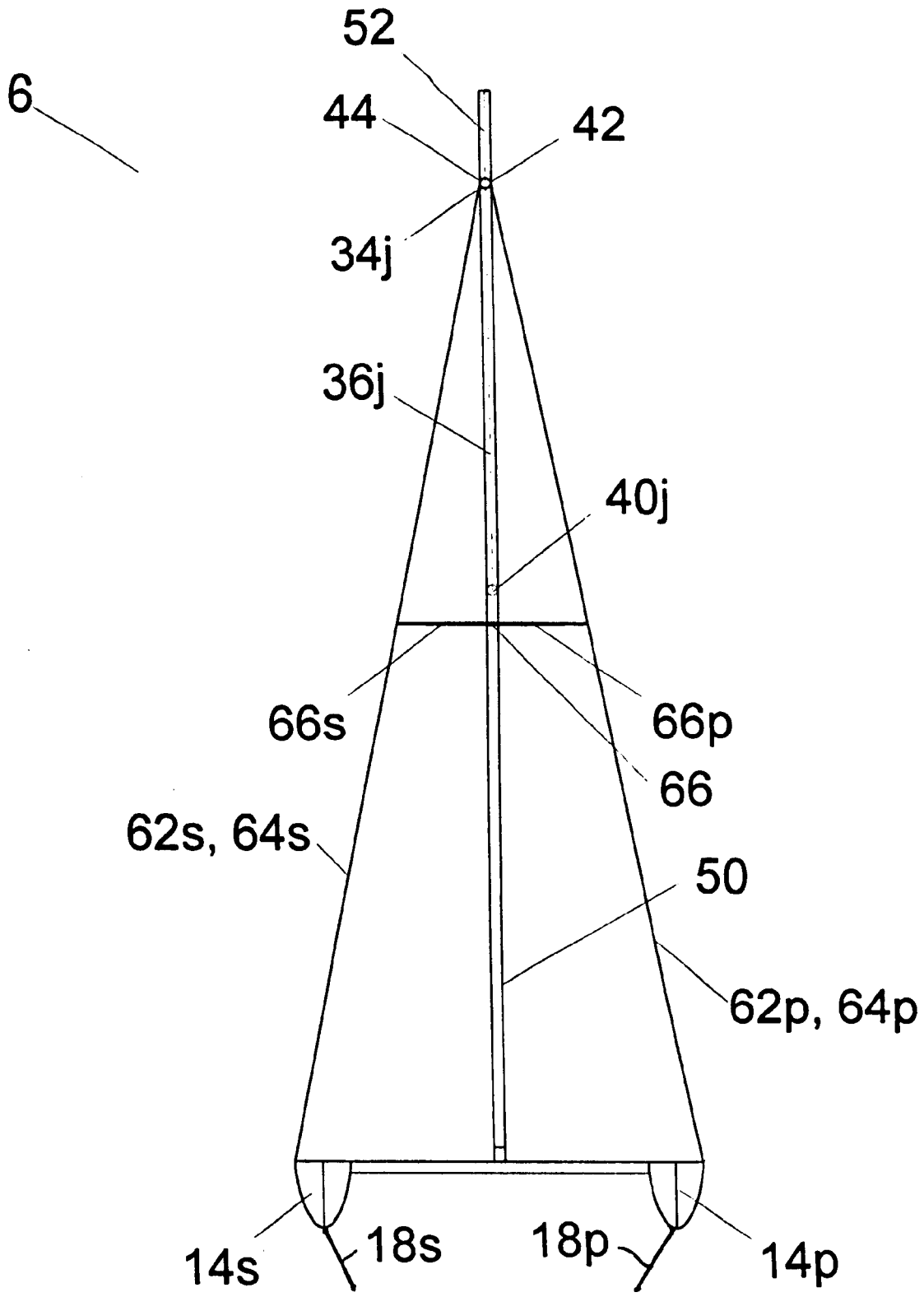

FIG. 9 is an explanatory diagram of a first preferred embodiment of a simplified jib/mainsail aft-mast lifting-sail rig apparatus 6, an arrangement with dual sails, a jib 20*j* with a mainsail 20*m*, are mounted in tandem on mast-sprit 44 in close proximity to one another to gain the same "slot effect" advantage provided by a conventional jib and mainsail. The jib 20*j* and the mainsail 20*m* are each controlled in the same manner with a jib sheet 21*j* and a main sheet 21*m* respectively. The sheets 21*j* and 21*m* are attached to a common lower boom 30, and lead aloft (not shown) to the mast-sprit 44 and down the vertical mast 50 to the main deck 14*d* for trimming and independently adjusting the angle of attack of the jib 20*j* and the mainsail 20*m*. The two adjacent lifting-sails 20*j* and 20*m* may be supported by the low drag mast-sprit 44 stay 52 and aft vertical mast 50 as shown in FIG. 10, with starboard 66*s* and port 66*p* spreaders at the mast maximum buckling stress point 66, and supporting starboard 64*s* and port 64*p* backstays. Inward canted hydrofoil 18*s* on starboard hull 14*s*, and inward canted hydrofoil 18*p* on port hull 14*p* provide the lateral resistance. Directional control is provided by starboard 16*s* and port 16*p* rudders. Aerodynamically shaped, symmetrical airfoil luff-spars 28*j* and 28*m* are attached to or integral with the leading edges of the lifting-sail 20*j* and 20*m* respectively. Universal couplings 34*j* and 34*m* are connected to heads 54*j* and 54*m* of the luff-spars 28*j* and 28*m,* at the middle region of the mast-sprit 44. The lifting-sails 20*j* and 20*m* are hinged from the mast-sprit 44 with universal couplings 34*j* and 34*m* respectively for unrestricted upward tilting to produce a complete righting moment. Support of the luff-spars 28*j* and 28*m* against fore and aft pitching is controlled, particularly when sailing to windward, by two symmetrical airfoil fore-spars 36*j* and 36*m,* connected between luff-spar couplings 40*j* and 40*m* located in the mid region of the luff-spars 28*j* and 28*m,* and the couplings 42*j* and 42*m* respectively at the forward region of the mast-sprit 44. In this case, the lifting-sails 20*j* and 20*m* are rotated independently to adjust the angle of attack to the relative wind by rotating luff-spars 28*j* and 28*m* along a line between the luff-spar tacks 46*j* and 46*m* attached to the common lower boom 30 and the mast-sprit-spar universal coupling 34*j* and 34*m* located at the mid-region of the mast-sprit 44. Tilt sheet 60 is attached to the lower boom 30 and leads aft to the main deck 14*d* for ease of upward tilt adjustment of the lifting-sail 20*j* and 20*m* assemblies.

FIG. 11 is an explanatory diagram of a preferred embodiment rotating bi-plane lifting-sail rig apparatus 7, comprising a biplane with two widely spaced lifting-sails 20 or lifting-airfoils 22 The biplane with dual lifting-sails 20 are spaced widely apart, preferably the length of the luff-spar 28, to minimize aerodynamic interference and induced drag, while increasing the righting moment with a lowered center of effort. The lower the center of gravity lifting-sails 20 or lifting-airfoils 22 which may be fixed or rotated on vertical mast 50 to a head on lateral bi-plane position (not shown), or to the advantageous "safe leeward position" orientation as shown in FIG. 11. With the large free area derived-from the widely spaced apart dual lifting-sails 20, the main trimaran hull 14*t* may be utilized as a crew cockpit, or cabin without interference from the rotating lifting-sail rig. Alternatively, the large main hull 14*t* may comprise an elevated self righting, detachable "life support" capsule or large crew pod 71 with a spaceship-like quality. Ultimate safety and heavy weather multihull operation is achieved with the sea-keeping ability and built in life saving provision.

The bi-plane rotary yardarm 68 mounted on the rotary yardarm bearing 69, supports the widely spaced dual lifting-sails 20 with sail battens 31, each with a mast-sprit/luff spar head universal coupling 34, a mast sprit coupling 42, and a symmetrical airfoil fore-spar 36 connecting to a luff-spar coupling 40. The widely spaced dual lifting-sails 20 are each controlled by a luff-spar/sail or airfoil tilt sheet 60 attached to the luff-spar tack 56 and leading to the main hull 14*t*. The angle of attack of each lifting-sail 20 is controlled by an upper sail/airfoil angle of attack control sheet 38, which is attached to an upper wishbone boom 32*w* and leading to the yardarm 68 down to the main hull 14*t*. The rotating bi-plane lifting-sail rig apparatus 7 has a lower center of gravity lifting-sail 20 and center of effort 20*ce* below the fixed mast 50 for easy structural support, handling and balance of aerodynamic and gravity forces. In addition, by lowering the lifting sail force Fs center of effort 20*ce,* the righting moment of the lifting-sail rig may be maximized by moving the keel or hydrofoil 18 force Fr center of lateral resistance 18*clr*, as shown in FIG. 1 of the lifting-sail method and apparatus 2, as far to windward as possible to cancel the overturning moment at a near vertical angle of each lifting-sail 20 for maximum effectiveness. In the case of the rotating bi-plane lifting-sail rig apparatus 7, the lifting-sail rig 20 heels the multihull to windward moving the center of lateral resistance 20*clr*, furthest from the lifting center of effort 20*ce*, at the fin or keel 18*s* of a windward ama, or outrigger 14*s* of the trimaran 14*t*.

Figure 12:
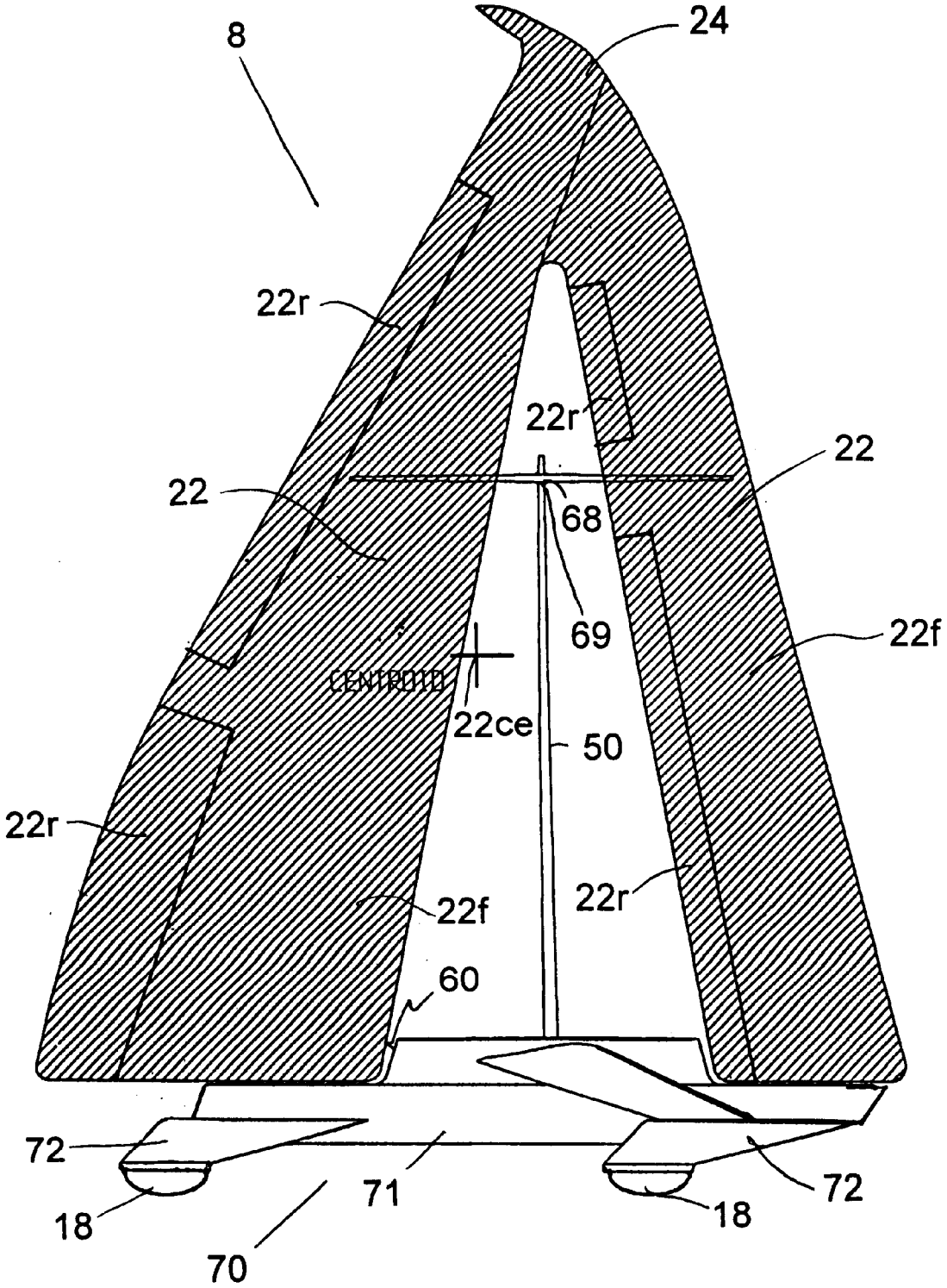
FIGS. 12 and 13 are the explanatory diagrams of a first preferred embodiment of the lifting-sail rig apparatus to maximize the hull speed in relatively calm seas, with small surface area, short planing hulls or pods. Having reduced hydrodynamic drag, particularly as a catamaran, trimaran, or other unique craft with a plurality, of three, preferably four widely spaced, short planing pods for maximum stability, are interconnected in a symmetrical array, with hydrofoils for lift and steering control. A unique joined tandem lifting-airfoil is mounted on a horizontal yardarm for upward tilting. The horizontal yardarm is mounted on a fixed mast for vertical rotation of the lifting-airfoil, to vary the angle of attack and the camber with rear flaps. The low inertia, simple joined tandem lifting-airfoil mounted on the rotating yardarm results in a lowered center of effort.
Figure 13:
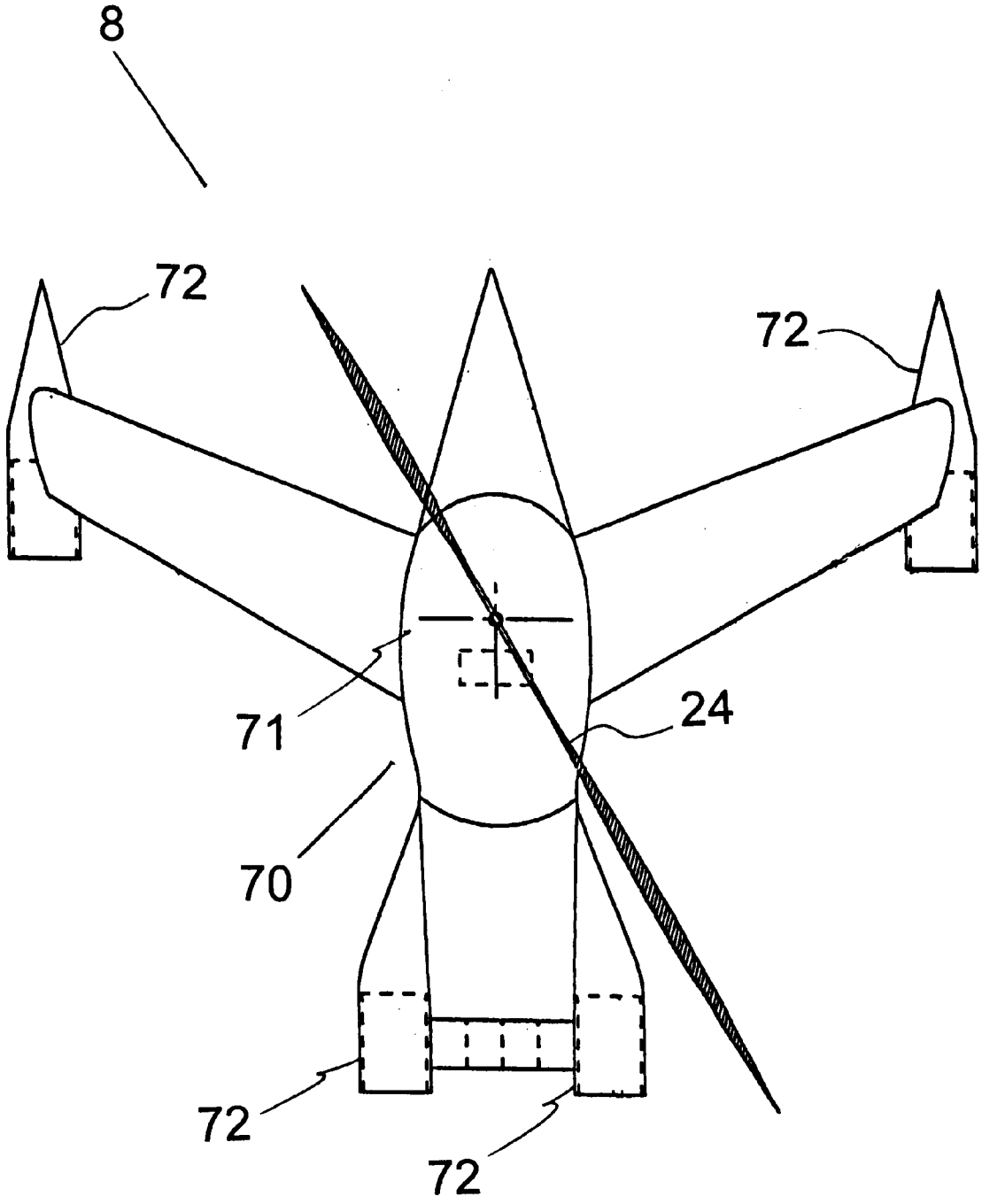

FIGS. 12 and 13 are the explanatory diagrams of a first preferred embodiment of a joined dual tandem airfoil lifting-sail rig apparatus 8, shown with large elevated crew capsule 71 with small surface area, short planing hulls or pods 72 to maximize the planing multihull 70 speed in relatively calm seas. The joined dual tandem airfoil lifting-sail rig apparatus 8, comprises a dual joined tandem symmetrical lifting-airfoil 24, where each lifting-airfoil 22 may have a lifting-airfoil forward wing 22*f* with lifting-airfoil rear flaps 22*r,* or as a slotted symmetrical lifting-airfoil 24 a lifting-airfoil middle wing 22*m* would be included. The joined dual tandem symmetrical lifting-airfoil 24 is supported by a horizontal yardarm 68 mounted on a rotary yardarm bearing 69. The widely spaced joined dual lifting-airfoils 22 are each controlled by a tilt sheet 60 or other means such as tilt motor (not shown) on the yardarm 68 horizontal axis. The angle of attack of the joined dual tandem symmetrical lifting-airfoil 24 about the vertical mast 50 is controlled by the rotation of the lifting-airfoil rear flaps 22*r* on the dual lifting-airfoils 22. The joined dual tandem airfoil lifting-sail rig apparatus 8 has a lower center of gravity and center of effort 20*ce* below the fixed mast 50 for easier structural support, handling and the balance of aerodynamic and gravity forces. The planing multihull 70 has reduced hydrodynamic drag with an elevated crew capsule 71 and a plurality of three, preferably four widely spaced of short planing pods 72 interconnected in a symmetrical array as shown in FIG. 13, with small hydrofoils 18 for lift control. Small surface area, short planing pods 72 have proven successful with reduced hydrodynamic drag in relatively calm seas, without reliance on large hydrofoils, which may limit the speed with cavitation drag. The righting moment of the joined dual tandem airfoil lifting-sail rig apparatus 8 is maximized by moving the center of lateral resistance 18*clr* of the hydrofoils 18 as far to windward as possible to cancel the overturning moment at a near vertical angle of the joined dual tandem symmetrical lifting-airfoil 24, i.e. for maximum effectiveness as shown in FIG. 1, by causing the symmetrical lifting-airfoil 24 to heel the planing multihull 70 to windward to move the center of lateral resistance 18*clr* of the keel 18 force Fr of a windward outrigger planing pod 72 furthest from the lifting-airfoil 24 force Fs at the lifting center of effort 22*ce*. With the large free area derived from the widely spaced apart dual joined airfoils 22 of the symmetrical lifting-airfoil 24 the planing multihull 70 may include an elevated capsule 71 that may be utilized as a crew cockpit, or cabin without interference from the rotating symmetrical lifting-airfoil 24. The large planning multihull 70 may comprise a self righting, detachable "life support" crew elevated capsule 71 with a spaceship-like quality. Ultimate safety and heavy weather multihull 70 operation is achieved with sea-keeping ability with a built in life saving capsule 71 elevated above the water surface.

Figure 14:
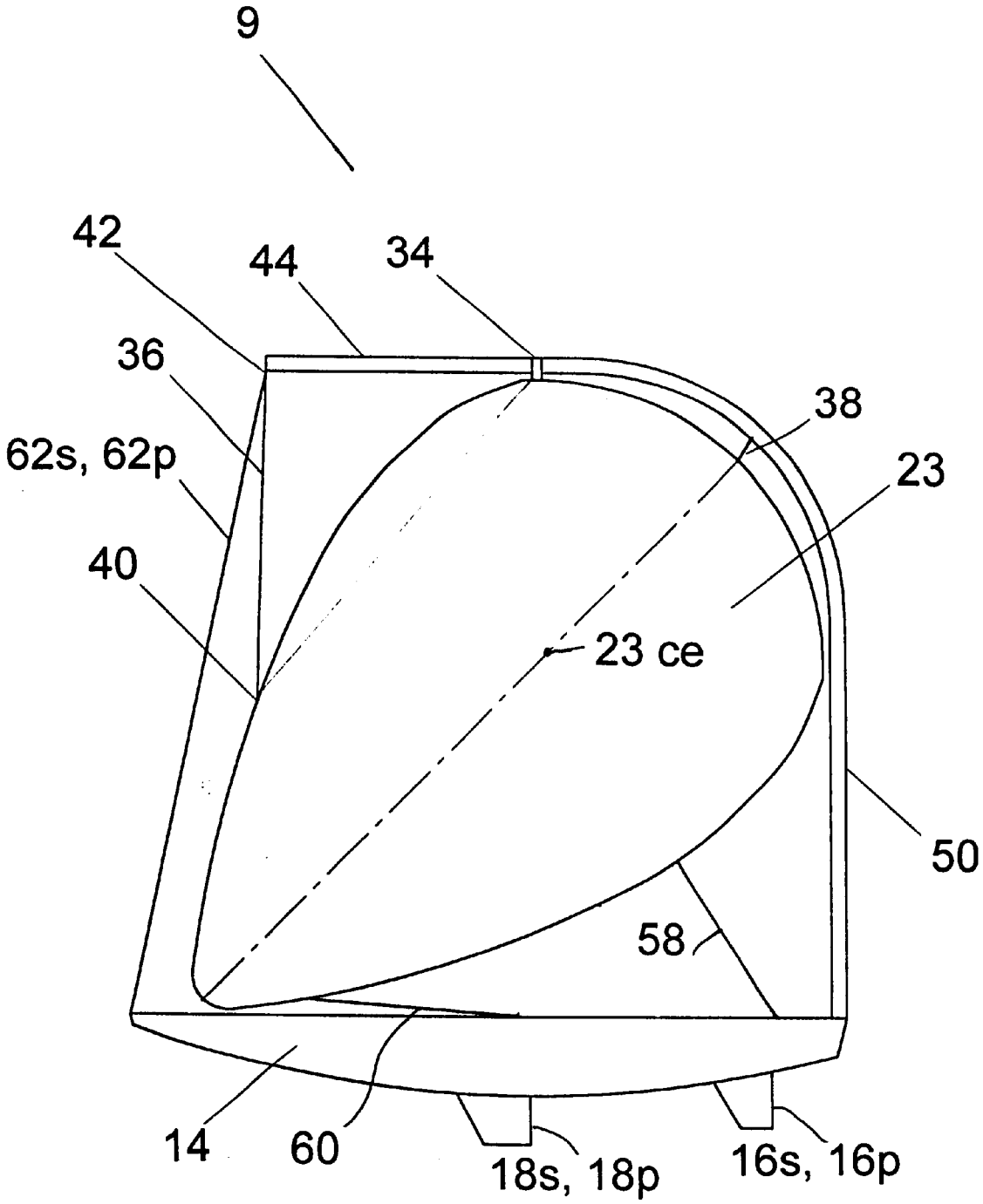
FIG. 14 is an explanatory diagram of a preferred embodiment employing an efficient delta shaped sail or wing with the lifting-sail rig apparatus and method. With a lower center of effort, the delta lifting-sail rig is preferably light in weight and inflatable similar to conventional delta shaped hang-gliders and kites.

FIG. 14 is an explanatory diagram of a preferred embodiment of a delta airfoil aft mast lifting-sail rig apparatus 9 employing an efficient delta shaped sail or wing 23 with a low center of effort 23*ce*. The delta lifting-sail or wing 23 is preferably light in weight and may be solid or inflatable similar to conventional delta shaped hang-gliders and kites. FIG. 14 shows the same principle as the aft mast lifting-sail rig apparatus 3 or similarly a reinforced lifting-sail rig apparatus 4 and method of operation, with the embodiments shown in FIGS. 1 through 6, except with a delta shaped lifting-sail 23. The shorter height of the high lift, delta shaped sail 23 has the advantage of a lower sail force center of effort 23*ce* with a large sail area resulting in a smaller heeling moment with a large sail driving force. The delta airfoil aft mast lifting-sail rig, apparatus 9 may comprise a fixed vertical mast 50 with a short mast-sprit 44 projecting forward at the top of the vertical mast 50 for supporting the delta lifting-sail 23. The vertical mast 50, is positioned aft of the delta lifting-sail 23 without aerodynamic interference. The mast sprit 44 is laterally supported by two widely spaced starboard 62*s* and port 62*p* forestays attached to an extended beam planning hull 14. The aft vertical mast 50 may be supported by two widely spaced starboard 64*s* and port 63*p* backstays (not shown). The center of lateral resistance 18*cr* is located on hydrofoil 18*s* on starboard side of extended beam planning hull 14, and hydrofoil 18*p* on the port side. Directional control is provided by starboard 16*s* and port 16*p* rudders. The mast-sprit 44 to the delta lifting-sail 23 universal coupling 34 is connected to the to the middle region of the mast-sprit 44 for hinging the delta lifting-sail 23 for unrestricted upward tilting to produce a complete righting moment. Support of the delta lifting-sail 23 against fore and aft pitching is controlled, particularly when sailing to windward, by a substantial guy wire 36*g*. The guy wire 36*g* is connected between a delta luff-sail coupling 40 located in the mid region of the luff-spar 28 and a coupling 42 at the forward end of the mast-sprit 44. Simple rotation of the delta lifting-sail 23 for adjusting its angle of attack to the relative wind is about an axis defined by a line between the delta luff-sail coupling 40 attached to the leading edge of the delta lifting-sail 23 and the mast-sprit-spar universal coupling 34. An upper angle of attack control sheet 38 may be attached to the lower edge of the delta lifting-sail 23 and lead to the deck 14*d* A lower angle of attack control sheet 58 may be attached to the lower edge of the delta lifting-sail 23 and lead to the deck 14*d* for additional control. The delta lifting-sail 23 tilt sheet 60 is also attached to the forward lower edge of the delta lifting-sail 23 and leads aft to the deck 14*d* for ease of upward tilt adjustment and for tensioning guy wire 36*g*, particularly for sailing down wind.

Figure 15:
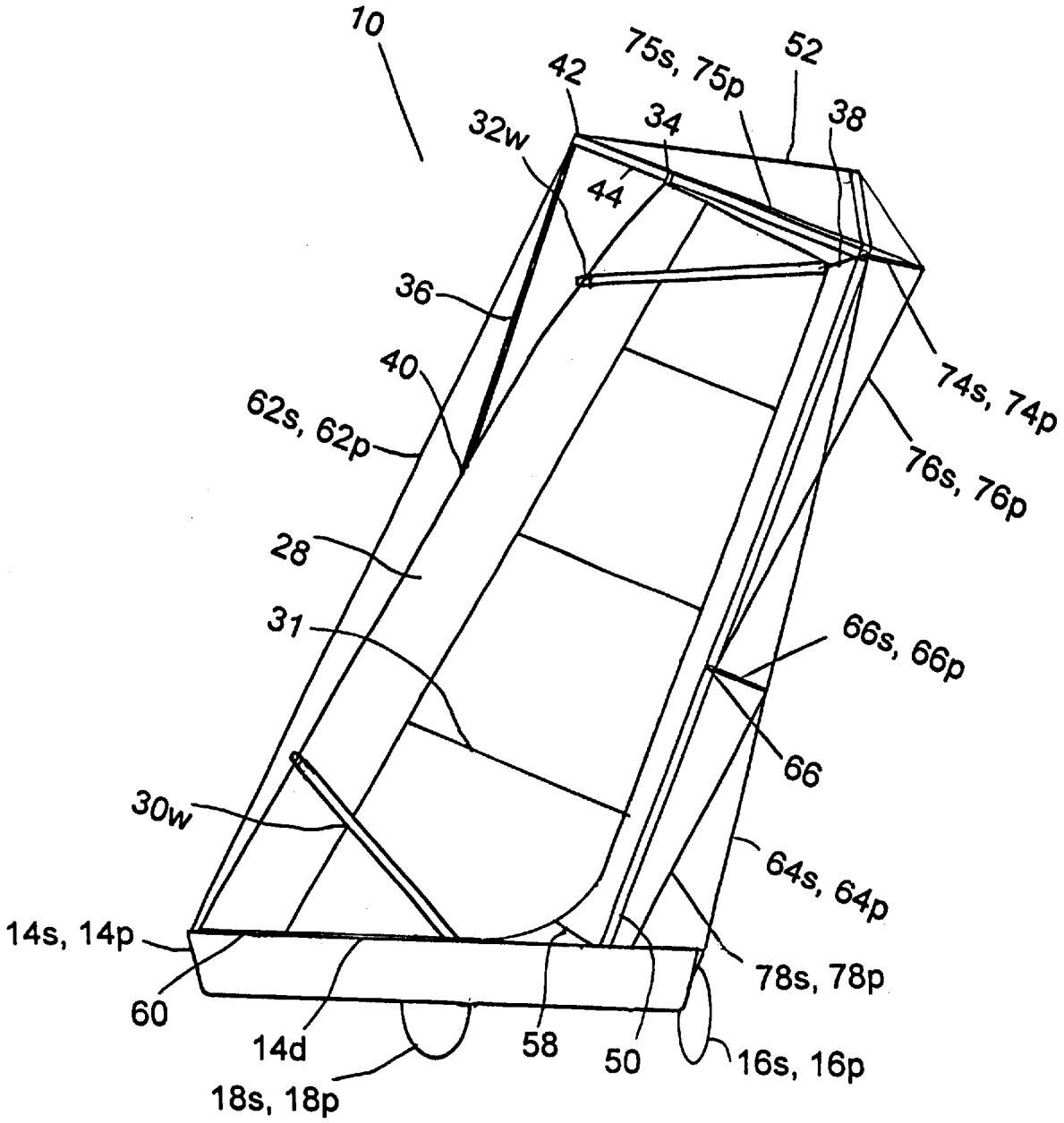
FIGS. 15 and 16 are the explanatory diagrams of a preferred embodiment of the lifting-sail rig, for offshore cruising with a heavy duty mast and mast-sprit reinforced with additional, heavy duty spreaders and stays.
Figure 16:
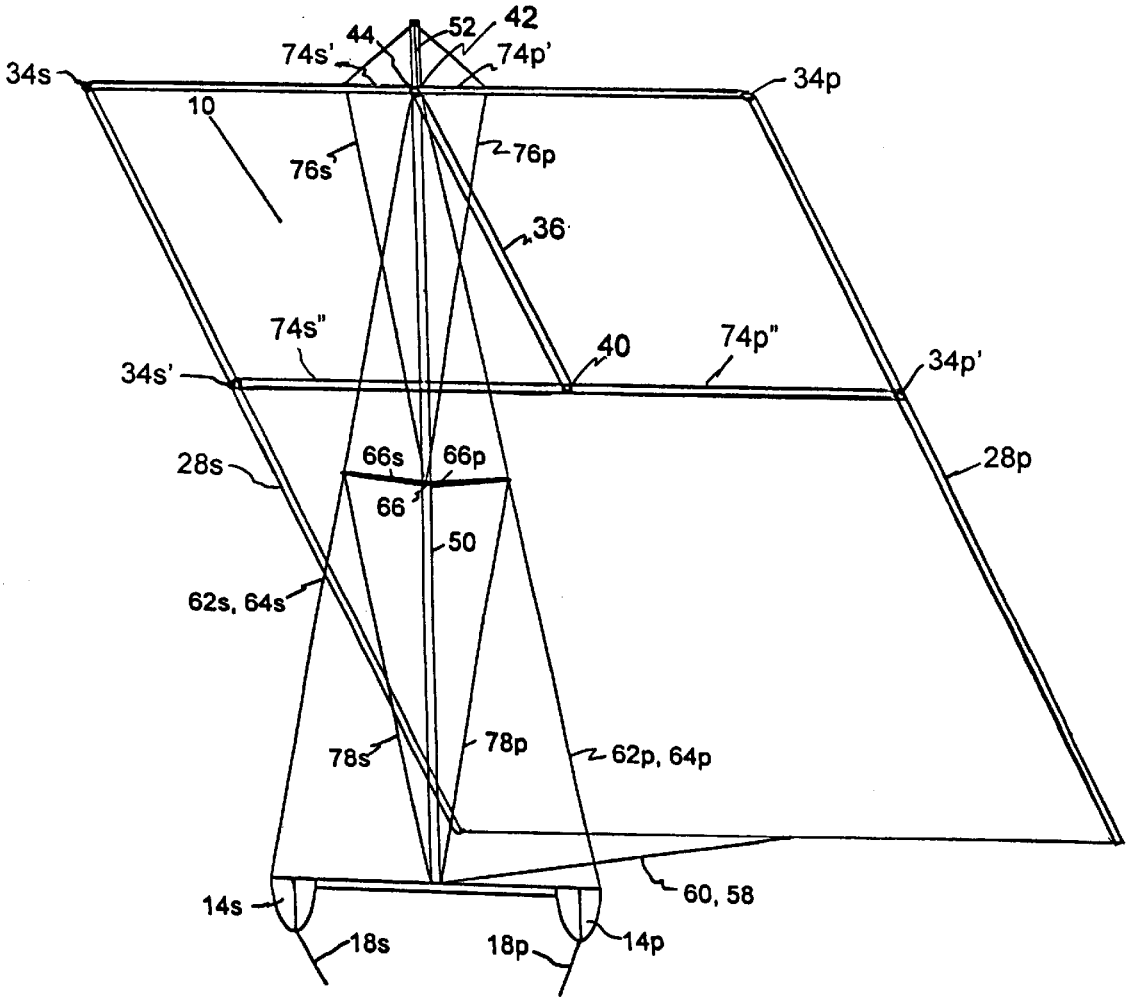

FIGS. 15 and 16 are the explanatory diagrams of a preferred embodiment of the reinforced aft mast midpoint spreader lifting-sail rig apparatus 10 with a biplane rig for a lower center of effort of the sail force and reinforced additional, heavy duty spreaders and stays for offshore cruising. This alternative provides a substantial, seaworthy rig for ocean cruising and racing, with a high resistance to pitch, roll, and yaw to prevent distortion of the biplane lifting-sail 20 rig and resist buckling the vertical mast 50. The biplane rig is shown in FIG. 16 with a luff spar 28*s* attached to the outer end of a rigid starboard mast-sprit spreader 74*s*' and a luff-spar 28*p* attached to the outer end of a rigid port mast-sprit spreader 74*p*', wherein the 74*s*' and 74*p*' inner ends are rigidly joined to the mast-sprit 44 to provide the outboard location of the universal couplings 34 for mounting the luff-spars 28*s* and 28*p* respectively. The luff-spars 28*s* and 28*p* are-hinged from said 74*s*" and 74*p*' with universal couplings 34 for unrestricted outward tilting to produce a complete righting moment, and pure rotation about their respective luff-spar axes to vary the sails 20*s* and 20*p* angle of attack. The aerodynamically shaped, symmetrical airfoil luff-spars 28 are attached to or integral with the leading edge of the lifting-sails 20.

Support of the luff-spar 28 against fore and aft pitching is controlled, particularly when sailing to windward, by a symmetrical airfoil fore-spar 36 connected between a fore-spar/mast sprint coupling 40 located at the center point of the integral or rigid joint between horizontal spreader spar 74*s*", and horizontal spreader spar 74*p*", and a mast-sprit coupling 42 at the forward region of the mast-sprit 44. A movable symmetrical four-bar linkage, with 74*s*" and 74*p*" the fixed link, is created by the connections 34*s*' and 34*p*' to 74*s*" and 74*p*" respectively. The lifting-sails 20 are rotated to adjust the angle of attack to the relative wind by rotating luff-spars 28 along a line between the luff-spar tack 46 attached to the upper wishbone booms 32*w* and the mast-sprit-spar universal coupling 34 located at the ends of the spreaders 74*s*' and 74*p*'. For additional control, a lower angle of attack control sheet 58 may be attached to the wishbone booms 30*w* at the lower edge of the lifting-sails 20 and lead to the main deck 14*d*. Tilt sheet 60 is attached to the lower wishbone boom 30*w* and leads aft to the deck 14*d* for ease of upward tilt adjustment, while maintaining tension in fore-spar 36, particularly for sailing down wind. The angle of attack sheets 38 are attached to the upper wishbone booms 32*w*, leading to the mast-sprit 44 and down the vertical mast 50 to the main deck 14*d* for trimming.

The biplane lifting-sails 20 are supported by the low drag mast-sprit 44 with mast-sprit stay 52 and aft vertical mast 50 as shown in FIG. 15 with starboard 66*s* and port 66*p* mast spreaders at the mast maximum buckling stress point 66, and supporting starboard 64*s* and port 64*p* mast backstays. The reinforced aft mast midpoint spreader lifting-sail rig apparatus 10 has additional support of mast-sprit 44 with starboard mast-sprit spreader 74*s* and rigid port mast-sprit spreader 74*p* on the vertical mast 50. Lateral mast-sprit stay 75*s* and lateral mast-sprit stay 75*p* are attached to the ends of rigid mast-sprit starboard 74*s* and port 74*p* spreader respectively, to counteract yawing of the mast-sprit 44. As shown in FIG. 16, a front view of the reinforced aft mast midpoint spreader lifting-sail rig apparatus 10, the starboard jumper stay 76*s* and port jumper stay 76*p* attached to the rigid starboard mast-sprit spreader 74*s* and rigid port mast-sprit spreader 74*p* respectively, are joined to the vertical mast 50 maximum buckling stress point 28 to counteract pitching and yawing of the mast-sprit 44. The starboard mast jumper stay 78*s* and port mast jumper stay 78*p* joined at the end of rigid starboard mast spreader 66*s* and rigid port mast spreader 66*p* respectively, are attached to the main deck 14*d* at the mast 50 for additional resistance against pitching and yawing. Inward canted-hydrofoil 18*s* on starboard hull 14*s*, and inward canted hydrofoil 18*p* on port hull 14*p* provide the lateral resistance. Directional control is provided by starboard rudder 16*s* and port 16*p* rudder.

Figure 17:
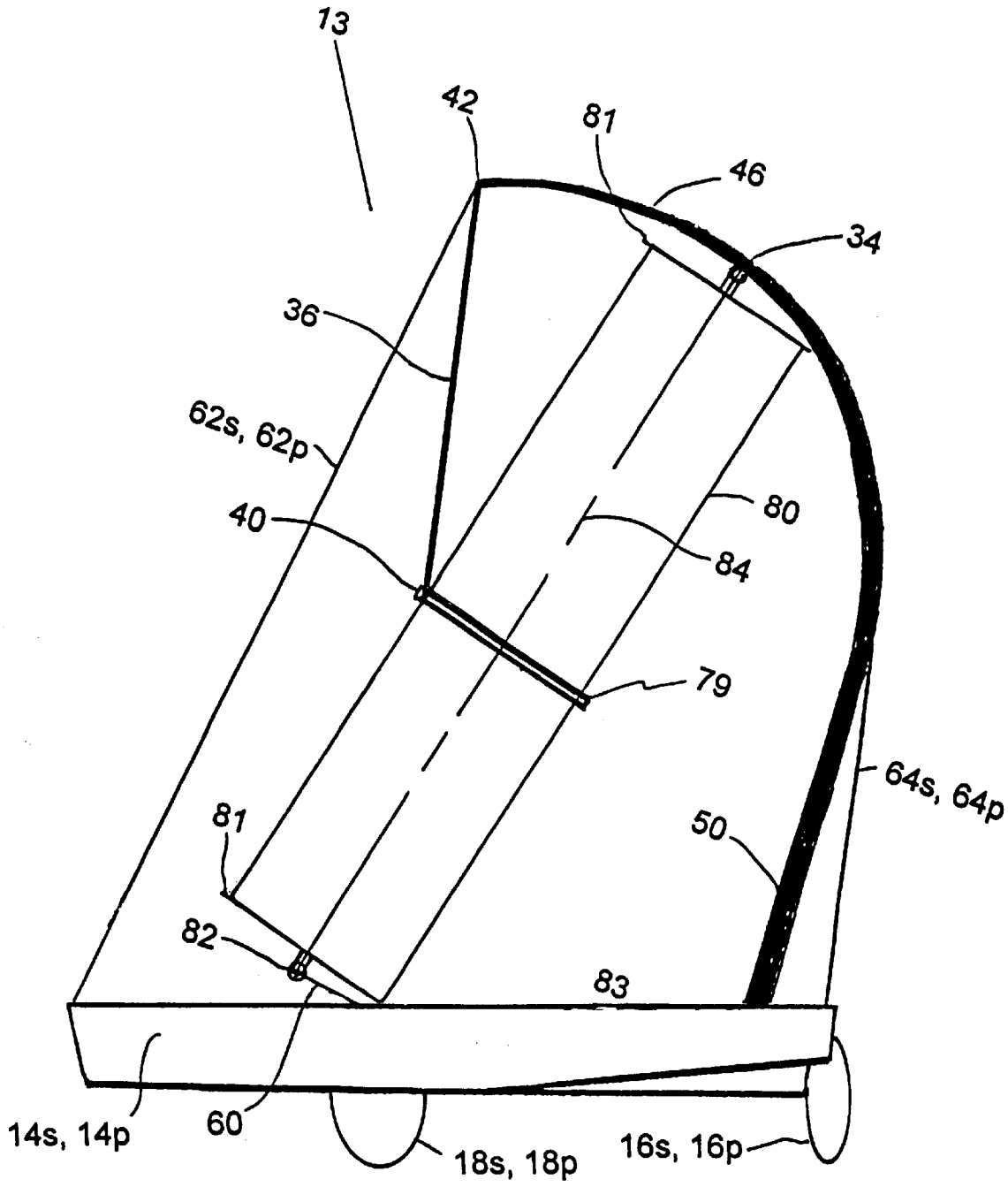
FIG. 17 is an explanatory diagram of an alternative embodiment comprising a lifting-rotor used in place of a lifting-sail. The lifting-rotor rig generates aerodynamic driving force only when the airfoil cylinder is rotated, or driven about its central axis. Therefore, the driving force is safely controlled by the speed of rotation even in strong winds.

FIG. 17 is an explanatory diagram of an alternative embodiment comprising a lifting-rotor, known as a Flettner Rotor, may be used in place of a lifting-sail. The lifting-rotor rig generates aerodynamic driving force only when the airfoil cylinder 80 is rotated, or driven about its central axis 84. Therefore, the driving force is safely controlled by the speed of rotation of rotor 80 even in strong winds. The bent flexible mast rig as shown in FIG. 17 supports the lifting-rotor in the same manner as the lifting-sail.

Flexible bent mast-sprit 46 is connected to the upper end of rotor 80 by universal coupling 34 at the rotor axis of rotation 84. Coupling 40 connects the central rotor ring bearing 79 to the lower end of the fore-spar 36, while the mast-sprit rotary coupling 42 connects the fore-spar 36 to the forward tip of the bent mast sprit 46. Lifting-rotor lower bearing 82 is located on the lower end of the rotor 80 at the central axis 84 and connects to the airfoil rotor tilt sheet 60. Symmetrical airfoil vertical mast 50 is supported by starboard backstay 64*s* and port backstay 64*p*. Flexible bent mast-sprit 46 is supported by starboard forestay 62*s* and port forestay 62*p*. Lifting-rotor end plates 81 may be used to increase the aerodynamic efficiency of rotor 80. Lifting-rotor drive motor 83 rotates the rotor 80 at the desired velocity about the lifting-rotor axis of rotation 84. Upper Sail/Airfoil Angle of Attack Control Sheet 38 and Lower Sail/Airfoil Angle of Attack Control Sheet 58 are not necessary.

Figure 18:
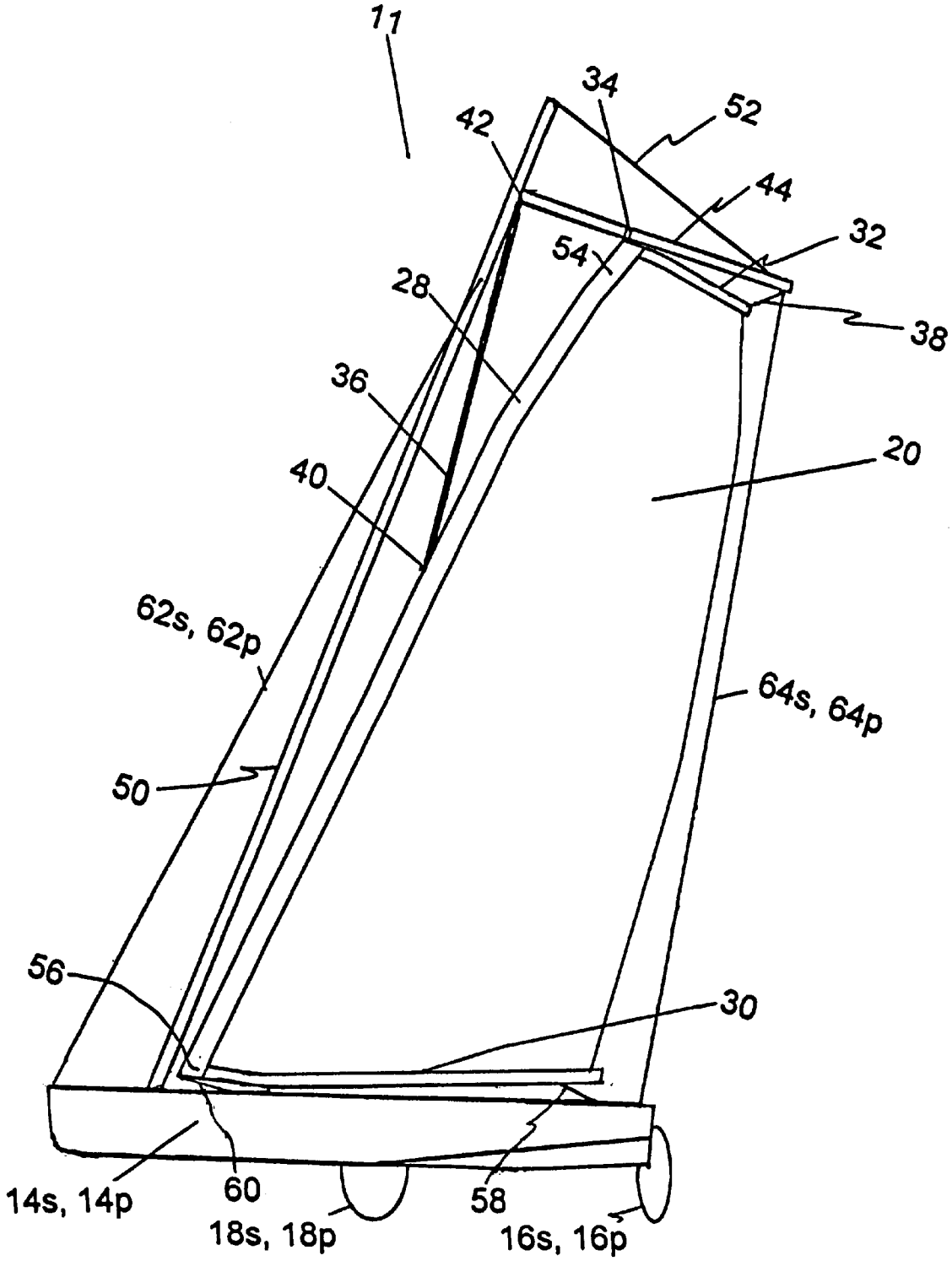
FIG. 18 is an explanatory diagrams of an alternative embodiment of the lifting-sail rig, comprising a low aerodynamic drag sail, a vertical mast with a mast-sprit, inward canted hydrofoils, and four simple supporting stays. The aerodynamic mast and rig with minimum spars and stays of low drag is positioned forward and away from the lifting-sail with the mast-sprit extending aft.

FIG. 18 is an explanatory diagram of an alternative embodiment forward mast lifting-sail rig apparatus 11 comprising an aerodynamic vertical mast 50 mast positioned forward of the low aerodynamic drag lifting-sail 20 with an aft leading mast-sprit 44. The aft leading mast-sprit 44 is supported by mast-sprit stay 52, starboard backstay 64*s* and port backstay 64*p*. The vertical mast 50 may be supported by starboard forestay 62*s* and port forestay 62*p*. Aerodynamically shaped, symmetrical airfoil luff-spar 28 is attached to or integral with the leading edge of the lifting-sail 20. The lifting-sail 20 is hinged from the mast-sprit 44 with universal coupling 34 for unrestricted outward tilting to produce a complete righting moment. Universal coupling 34 is connected to luff-spar head 54 of the luff-spar 28, at the middle region of the mast-sprit 44. Support of the luff-spar 28 against fore and aft pitching is controlled, particularly when sailing to windward, by substantial guy wire 36*g* connected between a luff-spar coupling 40 located in the mid region of the luff-spar 28, and a mast-sprit coupling 42 respectively at the forward region of the mast-sprit 44. The angle of attack to the relative wind is adjusted by rotating luff-spar 28 of the lifting-sail 20 along a line between the luff-spar tack 46 attached to the upper sail boom 32 and the mast-sprit-spar universal coupling 34 located at the mid-region of the mast-sprit 44. For additional control, a lower angle of attack control sheet 58 may be attached to the wishbone boom 30*w* at the lower edge of the lifting-sail 20 and lead to the main deck 14*d*. Tilt sheet 60 is attached to the lower wishbone boom 30*w* leading aft to the deck 14*d* for ease of upward tilt adjustment, while maintaining tension in guy wire 36*g*, particularly for sailing down wind. Inward canted hydrofoil 18*s* on starboard hull 14*s*, and inward canted hydrofoil 18*p* on port hull 14*p* provide the lateral resistance. Directional control is provided by starboard 16*s* and port 16*p* rudders.

Although the description above contains many specificities, these should not be construed as limiting the scope of the invention but as merely providing illustrations of some of the presently preferred embodiments of this invention, other embodiments and ramifications are possible within it's scope, modification, and substitution of similar assemblies and parts. Other embodiments may be constructed from and consist of related lifting-sail rigs interchanged with the various disclosed lifting sail and airfoil rigs, apparatus and methods as disclosed.

I claim:

1. A lifting sail craft having a hull, a mast, and a sail supported in the upper vicinity of the top of the mast, comprising means for supporting a luff spar of the sail having an upper end and a lower end on a sprit member fixed to the mast without aerodynamic interference with the sail in the upper vicinity of the top of the mast;

means for articulately connecting the luff spar to the sprit member to permit the luff spar to tilt with respect to the mast and to rotate the luff spar with the sail on changing course with respect to the wind, the connecting means being universally coupled to the mid region of the sprit member, and being attached near the upper end of the luff spar at a point above the center of effort of the sail and the center of lateral resistance of the hull;

means for directly connecting the mid region of the luff spar with a fore member to the end region of the sprit member for controlling the rake angle of the luff spar and the sail with respect the mast, in response to dynamic wind pressure on the sail, wherein upon the dynamic means to incline the sail at an upward angle to the mast line, the center of effort of the sail passes thru the center of lateral resistance of the hull, the sail exerts substantially no overturning effort on the hull;

means for controlling the tilt angle of the luff spar with respect to the mast and means for controlling the rotation of the luff spar with respect to the wind direction.

2. The lifting sail craft of claim 1, wherein the sprit member is integral with the mast in the form of a flexible bent mast.

3. The lifting sail craft of claim 1, wherein the sprit member is integral with the mast in the form of a forward raked mast.

4. The lifting sail craft of claim 1, wherein the sprit member projects substantially horizontal from the top region of the mast.

5. The lifting sail craft of claim 1, wherein the sprit member projects substantially horizontal from the top region of an "A" frame mast.

6. The lifting sail craft of claim 1, wherein the luff spar is in the shape of a wing mast.

7. The lifting sail craft of claim 1, wherein the sail is a slotted wing with the luff spar in the shape of a wing mast.

8. The lifting sail craft of claim 1, wherein the sail is a delta shaped wing.

9. The lifting sail craft of claim 1, wherein the sail rig comprises two tandem sails with independent operation and control.

10. The lifting sail craft of claim 1, wherein the sail rig comprises two tandem sails joined together at the top region and having a common substantially horizontal mounting member for tilting the sail rig, the common substantially horizontal mounting member is mounted for rotation on the top portion of the mast.

11. The lifting sail craft of claim 1, wherein the sail rig comprises two tandem sails joined respectively for staggered biplane operation at opposite end regions of a horizontal sprit member, which is rotatably mounted at the top region of the mast, wherein the horizontal sprit member provides fore members for tilting the sail rig, and rotating the sails with the wind direction.

12. The lifting sail craft of claim 1, wherein the sail rig comprises two biplane sails joined together at a distance in the vicinity one span to avoid interference drag between sails.

13. The lifting sail craft of claim 1, wherein the luff spar and sail is comprised of a Flettner Rotor.

14. A lifting sail craft having a hull, a mast, and a sail supported in the upper vicinity of the top of the mast, comprising means for supporting a luff spar of the sail having an upper end and a lower end on a sprit member fixed to the mast without aerodynamic interference with the sail in the upper vicinity of the top of the mast;

means for articulately connecting the luff spar to the sprit member to permit the luff spar to tilt with respect to the mast and to rotate the luff spar with the sail on changing course with respect to the wind, the connecting means being universally coupled to the mid region of the sprit member, and being attached near the upper end of the luff spar at a point above the center of effort of the sail and the center of lateral resistance of the hull;

means for directly connecting the mid region of the luff spar with a fore member to the end region of the sprit member for controlling the rake angle of the luff spar and the sail with respect the mast, in response to dynamic wind pressure on the sail, wherein upon the dynamic means to incline the sail at an upward angle to the mast line.

* * * * *